US010501280B2

(12) United States Patent
Zaun

(10) Patent No.: US 10,501,280 B2
(45) Date of Patent: Dec. 10, 2019

(54) METHOD FOR WINDING A TECHNICAL YARN, YARN SPOOLING MACHINE, YARN SPOOLING MACHINE ASSEMBLY, AND METHOD FOR HANDLING A YARN SPOOL

(71) Applicant: Horst Zaun, Kollmar (DE)

(72) Inventor: Horst Zaun, Kollmar (DE)

( * ) Notice: Subject to any disclaimer, the term of this patent is extended or adjusted under 35 U.S.C. 154(b) by 123 days.

(21) Appl. No.: 15/607,932

(22) Filed: May 30, 2017

(65) Prior Publication Data

US 2017/0260017 A1 Sep. 14, 2017

Related U.S. Application Data

(63) Continuation of application No. PCT/EP2015/077806, filed on Nov. 26, 2015.

(30) Foreign Application Priority Data

Dec. 4, 2014 (DE) ..... 10 2014 117 921

(51) Int. Cl.
*B65H 49/32* (2006.01)
*B65H 54/54* (2006.01)
*B65H 54/72* (2006.01)

(52) U.S. Cl.
CPC ..... *B65H 49/322* (2013.01); *B65H 54/54* (2013.01); *B65H 54/72* (2013.01); *B65H 2701/314* (2013.01)

(58) Field of Classification Search
CPC ..... B65H 49/322; B65H 54/44; B65H 54/54; B65H 54/547; B65H 54/72; B65H 2701/314
See application file for complete search history.

(56) References Cited

U.S. PATENT DOCUMENTS

| | | | |
|---|---|---|---|
| 1,405,554 | A | 2/1922 | Ambro |
| 4,921,185 | A | 5/1990 | Baker |
| 5,836,536 | A | 11/1998 | Bodden |
| 2012/0286083 | A1 | 11/2012 | Lossa |

FOREIGN PATENT DOCUMENTS

| | | | | |
|---|---|---|---|---|
| DE | 1 949 423 | A | 4/1970 | |
| DE | 41 25 310 | A | 2/1992 | |
| DE | 100 36 861 | A1 | 4/2001 | |
| DE | 10 2011 052 699 | A1 | 2/2013 | |
| JP | S60 242155 | A | 12/1985 | |
| WO | 81/02882 | A | 10/1981 | |
| WO | 2007 083162 | A1 | 7/2007 | |
| WO | WO-2007083162 | A1 * | 7/2007 | ..... B65H 49/32 |
| WO | 2013 187964 | A | 12/2013 | |

* cited by examiner

*Primary Examiner* — William E Dondero
(74) *Attorney, Agent, or Firm* — Thomas | Horstemeyer, LLP

(57) ABSTRACT

The invention relates to the use of a yarn spool handling container (1) for a yarn spool (2). The yarn spool handling container (1) comprises a frame or a housing (6). With respect to the frame or housing (6), a spindle (15) is rotatably supported. In the yarn spool handling container (1) a winding and unwinding of the technical yarn occurs. The yarn spool (2) is arranged in the yarn spool handling container (1) even during stocking and transport.

16 Claims, 12 Drawing Sheets

METHOD FOR WINDING A TECHNICAL YARN, YARN SPOOLING MACHINE, YARN SPOOLING MACHINE ASSEMBLY, AND METHOD FOR HANDLING A YARN SPOOL

CROSS REFERENCE TO RELATED APPLICATIONS

This application is a continuation of International Application PCT/EP2015/077806 with an International Filing Date of Nov. 26, 2015 and claiming priority to co-pending German Patent Application No. DE 10 2014 117 921.8 entitled (English Translation) Use of a Yarn Spool Handling Carrier, Yarn Spooling Machine, yarn Spooling Machine Assembly and Method for Handling a Yarn Spool", filed on Dec. 4, 2014.

FIELD OF THE INVENTION

The invention relates to a method for winding a technical yarn. Such a "technical yarn" concerned by the invention, is a thread-shaped or ribbon-shaped spooling material, which is

- is pliable,
- is realized as a single filament or multifilament (for example with more than 12,000 single filaments up to 300,000 single filaments),
- has a length wound onto the yarn spool of more than 100 km (especially more than 200 km, more than 300 km up to a length of 600 km),
- has a weight/length (so-called "titer") in the region of 10,000 to 20,000 den [g/9,000 m] (e.g. from 12,000 to 16,000 den),
- is wound as a cross winding without a support of the front faces on drum discs and/or
- is wound and/or unwound with spooling speeds of at least 10 m/min (preferably more than 30 m/min or more than 50 m/min), where preferable the spooling speed in unwinding is much smaller than the given spooling speeds, especially smaller by a factor of at least 10.

Furthermore, the invention relates to a yarn spooling machine, a yarn spooling machine assembly and a method for handling a yarn spool.

BACKGROUND OF THE INVENTION

Technical yarns of the kind described in the beginning are wound into yarn spools with yarn spooling machines. The yarn spooling machines can have only one spooling station or several spooling stations on which yarn spools can be wound in parallel. In the region of a spooling station, the yarn spooling machine has a spindle driven by a rotary drive. For winding a yarn spool, first a sleeve is applied to the spindle. The yarn is then fed to the spooling station. After catching the yarn, a winding is produced on the sleeve. After completion of the yarn spool formed with sleeve and winding, the yarn spool is detached from the yarn spooling machine by removing the yarn spool from the spindle in the axial direction. The yarn spool is then transported and especially brought to a further processing station, in which for example the yarn is unwound, or to a stocking device for stocking the yarn spools. Generally, there is a demand for yarn spools on which as much yarn as possible is wound, where, however, an increase of the accommodating capacity for a yarn spool is limited due to the mass of the winding which then increases as well.

U.S. Pat. No. 1,405,554 discloses a rack for spools by means of which a tangling of a thread in unwinding is intended to be avoided. The rack has sheet-like side walls. Between the side walls, on the one hand several holding rods for spools with a thread and on the other hand holding rods for crochet thread balls extend. The rack is used to hold the spool stationary to it, which can also be the case during the unwinding of the thread.

U.S. Pat. No. 4,921,185 discloses a rack for a spool for a yarn for knitting or crocheting. The rack is formed with two rods fixed to each other in an x-shaped and loose-jointed way. In its upper end portion one of the rods forms a half-shell-shaped receptacle for a telescopable shaft on which a winding of the yarn is placed. Here, too, the rack is used to hold the spool stationary to it, which can also be the case during the unwinding of the thread.

The document DE 100 36 861 A1 discloses a spooling machine on which spindles driven rotatably on a revolver are supported. The spindles have rotatable collet chucks. By means of the collet chucks it is possible to chuck on each spindle several sleeves arranged one after the other. The collet chuck is supported on the machine frame in one end portion. An additional support of the collet chuck is achieved on the opposite side of the collet chuck via an additional supporting device, which in a spooling position of the revolver is brought into engagement with the collet chuck. In order to achieve this, the supporting device comprises a carriage. By the carriage the supporting device is movable along two axes oriented orthogonally with respect to each other and lying in a plane oriented vertically to the longitudinal axis of the spindle.

The document WO 2007/083162 describes the winding of spools on a spindle of a spooling machine, the removal of the completely wound spool from the spindle of the spooling machine, the transport of the spool by means of a transport device to a storehouse, the removal of the spool from the transport device via a pivotable holder and the storing of the spool by means of a rack which comprises a horizontal spindle. After stocking (possibly over a span of several months), the spool is removed from the rack and again transported via the transport device, now to a rack from which then the spooling material is taken for further processing. The spooling material is to be unwound from the spool by pulling on the spooling material. On a rack several rows and columns of spools can be arranged. It is described as known here that the racks for several spools are realized as transport vehicles, in which way an exchange of the spools is to be accelerated. The holding device of the rack already comprises a guiding device for the spooling material. WO 2007/083162 proposes a transport vehicle for a spool. Frame trusses thereof are fixed to each other and extend along the edges of a cube. A vertical edge and the neighboring two upper horizontal edges of the cube are not equipped with edge trusses. On an additional vertical truss fixed to the edge trusses, a rotatable spindle is supported on which the spool is supported. The frame trusses are movably supported with respect to the floor via wheels. The spindle projects freely from the vertical truss. The spindle also extends out of the vertical truss on the side turned away from the spool with a free end portion. On this free end portion, a gearwheel is fixed. If a spool is supported on the spindle, the frame can on the one hand be displaced via the rolls, while on the other hand it is also possible that a transport of the spool is achieved by a fork of a forklift piler reaching below the underside of the frame. For the stocking of the spool, the frame can be arranged in a spool rack, which comprises a rotating organ and a yarn guiding device.

Several spools are arranged on the spool rack in a grid-like way. The rotating organ of the spool rack is formed with a gearwheel which engages with the gearwheel of the spindle. Via a brake device, a braking force can be applied onto the gearwheel. After the winding of the spool on a spooling machine, the spool is removed from the spooling machine and pushed onto the spindle of the transport vehicle. On the transport vehicle, the spool is then brought to the spool rack. With the application of a pulling force onto the spooling material, the release of the brake device occurs, in which way an unwinding of the spool is possible. A decrease of the pulling force leads to an actuation of the brake device and therefore a reduction of the rotational frequency of the spool. Alternatively, it is proposed that during the unwinding of the spooling material a driving of the spindle of the transport vehicle can be achieved via an electric motor. In an alternative embodiment, the transport vehicle can only be formed with a floor frame and vertical trusses protruding freely from the floor frame on which then the spindle is held rotatably.

US 2012/0286083 A1 also discloses a transport rack for a spool. This transport rack has hexagonal frame elements on its front face, on each of which a vertical truss is supported on which the spool can be rotatably supported. The transport rack comprises rolls via which the transport rack with the spool can be moved to different usage sites. The frame elements on the front face comprise an accommodating device via which it is possible to accommodate a spool through which a shaft protruding on the end side extends and which rests on the floor with its outer surface by a rolling motion of the transport frame. After such an accommodation of the spool, the spool is rotatably supported on the transport rack.

General prior art pertaining to the functioning of a spooling machine can be taken from DE 10 2011 052 699 A1 (corresponding to US 2013/0037647 A1).

DE 41 25 310 A1 discloses a winding machine wherein an endless synthetic yarn is pulled by a supply device via a yarn guide from a supply. The yarn is passed over a heating track, cooled back by a cooling track, curled by a curling device and then transferred by a supply device to a traversing unit. Under use of the traversing unit, the yarn is wound to a cross-wound package on a spool. The spool is driven by a contact roller which is driven by an electric motor. The contact roller is pressed against the outer circumference of the wound package of the spool. DE 41 25 310 A1 does not disclose the way the spool is supported.

DE 1 949 423 A1 also describes a method for winding a yarn to a spool wherein the spool is driven by a contact roller. However, here the contact roller is pressed against a flange of the spool.

Also according to the publication JP S60 242155 A, the spool is in rolling contact with four contact roller in the region of end-sided flanges of the spool. The contact rollers are distributed along the circumference of the flanges and pressed against the flanges.

The publications U.S. Pat. No. 5,836,536 A, WO 81/02882 A1 and WO 2013/187964 A1 relate to a non-generic technological field, namely cable drums.

SUMMARY OF THE INVENTION

It is an object of the present invention to propose
- a method for winding a yarn,
- a yarn spooling machine,
- a yarn spooling machine assembly and/or
- a method for handling a yarn spool, which are/is improved with respect to the handling of the yarn spools, especially the handling of yarn spools with a winding with a comparative high mass.

To begin with, the present invention firstly is based on an analysis of the reasons why for conventional yarn spools the mass of the winding is limited:

- In order to allow a sleeve to be able to be pushed onto the spindle and the yarn spool with the sleeve to be removed from the spindle after completion of the winding process in a conventional yarn winding machine, for a possible embodiment of a yarn winding machine the spindle freely protrudes from a frame of the yarn spooling machine with an "overhang support" of the spindle. With an increase of the mass of the yarn spool, higher stress on the bearings of the spindle occurs, where the bearings possibly are arranged with a distance from the front face of the yarn spool turned towards the frame with a gap. In this way the stresses on the bearings (which are anyway high due to the overhang support) increase even more. Therefore, the increase of the mass of the yarn spool necessitates a larger dimensioning of the bearings, which can lead to problems with construction space.
- Furthermore, an increase of the mass of the yarn spool leads to increased bending stress of the freely protruding spindle. If due to the increased bending stress a bowing of the spindle occurs, this leads to a decrease in the precision of the spooling process and deviations of the winding appearance from the specified winding appearance. The increased bending stress possibly has to be accounted for by an increased geometrical moment of inertia of the spindle, that is, especially an increased diameter of the spindle, which further aggravates the problems with construction space.
- With the increase of the mass of the yarn spool, the removal of the yarn spool from the spindle is complicated because the removal forces increase. In the removal of the yarn spool, affecting the winding is to be avoided because affecting the winding can lead to disturbances in the winding appearance and at worst to damages of the yarn. Therefore, the winding is lost for the application of the necessary removal forces.

After completing the winding, the spindle extends through the sleeve of the yarn spool, so that no removal forces can be applied to the yarn spool from the interior, either.

Therefore, usually the removal of the yarn spool from the spindle, which is usually achieved by pushing it onto a pin of a transport device, has to be achieved by action only onto a freely protruding end of the sleeve, which, however, cannot be sufficient for a large mass of the yarn spool.

- Corresponding problems result in yarn spooling machines in which the sleeve of the yarn spool during the spooling process is held in both end portions by bearing studs. The removal here necessitates as a first step a removal of one of the bearing studs so that the interior of the sleeve is made approachable from this side. With a bearing stud removed, the completely wound yarn spool, however, with its full weight rests only on the one remaining bearing stud, the bearing of which therefore has to be dimensioned in a corresponding way.
- A high mass of the winding also causes problems during a transport and a stocking or storage of the yarn spool: The high mass of the yarn spool even at a horizontal orientation of the yarn spool axes can lead to a "bowing" of the winding due to the gravitational forces, which leads to an undesired out-of-roundness of the winding and can lead to tensions and undesired strains in the yarn.

When pivoting the yarn spool during the transport, due to the high mass of the winding dynamic forces result which at worst affect the winding appearance negatively.

If during the transport or the stocking the yarn spool has to be put down onto its outer surface, with increasing weight of the yarn spool increasing surface pressures in the contact area of the winding result, which can lead to damages to the yarn.

For a solution to the object of the invention, the invention proposes to wind a technical yarn in a yarn spool handling container. Within the framework of the invention the "handling" which can be achieved by means of a yarn spool handling container consists of the winding of the yarn spool. It is also possible that the "handling" also comprises the accommodation, the supporting and/or holding of the yarn spool during

- the unwinding of the yarn spool,
- the removal of the yarn spool from the spindle or yarn spooling machine,
- the transport of the yarn spool,
- a braking or locking of the yarn spool and/or
- the stocking of the yarns spool.

The yarn spool handling container for a yarn spool according to the invention comprises a frame or housing. With respect to the frame or housing, a spindle is rotatably supported in (at least) one bearing. Preferably, the mentioned bearing supports the spindle in all radial directions to the spindle axis with respect to the frame or housing. The bearing can be realized as a slide bearing, while preferably a rolling bearing is employed. According to the invention, therefore the spindle is not supported on the yarn spooling machine but on the yarn spool handling container. In this context, the frame or the housing can be purposely adapted to the supporting or bearing and the stresses effective onto the spindle for a large mass of the yarn spool. Possibly, for an embodiment according to the invention, the bearings can be arranged closer to a front face of the yarn spool than this is the case for the supporting of the spindle on the yarn spooling machine. Therefore, according to the invention, the bearing stresses can be reduced and possibly a decreased bending stress on the spindle can be guaranteed. It is even possible for the spindle to be supported on the frame or housing on both sides of the yarn spool, in which way the "overhang support" (which is disadvantageous with respect to the mechanical stress) can be removed. The inventive embodiment, however, is also advantageous with respect to the handling of the yarn spool at removal, during transport and stocking: Removal forces, holding forces and transport forces can be applied directly onto the yarn spool handling container without removal forces, holding forces and transport forces having to be applied to the yarn spool and a possible sleeve. During a transport or the stocking, the yarn spool handling container can be put down onto the frame or housing. It is also possible that during a stocking the yarn spool handling container is arranged in a stocking shelf or an arrangement of several yarn spool handling containers one beside the other in a row and/or a stacking of several yarn spool handling containers one above the other is done. It is also possible that a yarn spool handling container is used multiple times so that at first a yarn spool is wound onto the yarn spool handling container which then possibly is unwound at another site. Subsequently, the yarn spool handling container can be reused with the same spindle to wind a new yarn spool onto it, and so on.

For inducing a driving movement for winding and/or unwinding of the yarn there are multiple possibilities. For a special proposal of the invention, the spindle has a spindle coupling element. The spindle coupling element is preferably arranged in an end region of the spindle protruding from the frame or housing. Via the spindle coupling element, the spindle can be detachably connected to the yarn spooling machine coupling element of a rotary drive of a yarn spooling machine in such a way that the transfer of a drive torque of the rotary drive to the spindle is achieved. It is possible, however, that such a spindle coupling element is not only used during winding or unwinding of the yarn. Rather than that, the spindle coupling element can also serve for a further handling of the yarn spool. It is possible, for example, that via the spindle coupling element transport forces are also applied to the yarn spool handling container. It is also possible that the spindle coupling element is used to rotate the yarn spool in the yarn spool handling container during the stocking, so that temporary gravitational forces effective in a circumferential portion of the winding are moved in the circumferential direction.

For the way of realizing the rotatably fixed connection between the spindle coupling element and the yarn spooling machine coupling element there are several possibilities known as such to the person skilled in the art. The coupling elements can, for example, transmit the drive torque in a friction-locking or form-locking way.

For example, the yarn spooling machine coupling element can be realized with a spline shaft or a splined key of a drive spigot of the rotary drive while the spindle coupling element is realized with a spline shaft inside profile or a splined key notch. Naturally, any other form-fitting transmission cross sections of the spindle coupling element and the yarn spooling machine coupling element are possible.

A possible friction locking can be realized

- by producing axial pressing forces between spindle coupling element and yarn spooling machine coupling element,
- possibly with a pressing of two contact tapers against one another or
- by forming a radial friction contact, for example by means of an expanding mandrel of the rotary drive which is splayed radially outwards and which is pressed against a hollow cylindrical interior surface of the spindle coupling element.

The coupling between the spindle coupling element and the yarn spooling machine coupling element can be achieved in any arbitrary way. Preferably, this coupling is achieved without the use of a tool, a screwed connection or similar. For example, the form-locking or friction-locking coupling can be achieved in a motion-controlled way when the yarn spool handling container and therefor the spindle coupling element approaches the yarn spooling machine and therefore the yarn spooling machine coupling element. During this approaching movement, the yarn spooling machine coupling element can enter into an opening of the spindle coupling element on its front side (or vice versa).

Generally, the frame or the housing can be realized in any way. For another embodiment of the invention, it is proposed that the frame or the housing comprises a supporting portion or holding portion which serves for supporting or holding the yarn spool handling container on a yarn spooling machine. For example, this can be a supporting portion formed by the frame or housing, which is supported on a supporting surface of the yarn spooling machine. It is also possible, however, that the holding of the yarn spool handling container on the yarn spooling machine is done in a holding portion on a side, top face and/or front face.

Alternatively or cumulatively it is possible that the frame or the housing comprises a handling portion for handling the yarn spool handling container. This can for example be a handling portion via which application forces, removal forces or transport forces can be applied to the yarn spool handling container. For example, a handling portion can be realized as a hook, eyelet or flap for a transport means. To mention only a non-limiting example, the yarn spool handling container can also comprise a handling portion in the shape of a receiving shoe for the prongs of a forklift piler.

Alternatively or cumulatively it is possible that the frame or the housing of the yarn spool handling container has a coupling portion in the area of which a coupling of the yarn spool handling container to another yarn spool handling container is possible. The coupling can be achieved with form locking, friction locking or use of a coupling or fixing means. To mention only a non-limiting example, the coupling portion can be realized with a protrusion or an indentation with which an indentation or a protrusion of a neighboring yarn spool handling container engages form-lockingly. The coupling portion is preferably realized suitably for a coupling of yarn spool handling containers standing one above the other and/or one next to the other.

Alternatively or cumulatively it is possible that the frame or the housing comprises a guiding unit. This guiding unit can enter into interaction with the yarn spooling machine to guarantee a correct coupling of the spindle coupling element to the yarn spooling machine coupling element and/or the coaxial alignment of the spindle to the rotary drive of the yarn spooling machine when the yarn spool handling container approaches the yarn spooling machine. It is also possible that the yarn spooling machine comprises rails with which the guiding unit of the yarn spool handling container enters into interaction with the aim of guiding the approaching movement of the yarn spool handling container to the yarn spooling machine.

The yarn spool handling container can be realized as any one-part or multiple-part construction unit, possibly with construction elements screwed to each other, welded with one another or connected with each other in another way. For a special proposition of the invention, the yarn spool handling container is formed with several construction elements releasably connected to each other. This means that by exchanging construction elements there can be an adaption of the yarn spool handling container to different requirements. To mention only an example, a yarn spool handling container can be formed with side parts or side trusses of different lengths in order to adapt the length of the yarn spool handling container and therefore the possible longitudinal extension of the yarn spool. Correspondingly, front face parts of the yarn spool handling container can also be provided in different sizes to enable a modification of the yarn spool handling container for yarn spools of different diameters. It is also possible that in the yarn spool handling container spindles of different lengths and/or diameters are used depending on the yarn spool to be wound. For the side parts or side trusses, the front face parts and the spindles individual adaption measures can be taken depending on yarn, yarn spooling machine, spooling process, winding appearance, traversing unit used, drive of the yarn spool and similar.

For another yarn spool handling container according to the invention, the housing or the frame is not realized as closed in the circumferential direction. Rather than that, the housing or the frame has an opening. This opening can on the one hand be used so that through this opening during the winding of the yarn the yarn can enter into the interior of the yarn spool handling container and/or through the opening be guided out of the interior of the yarn spool handling container during the unspooling.

It is also possible that in the region of the opening a traversing unit extends during use of the yarn spool handling container which is used for the traversing guiding of the yarn when laying the yarn onto the spool. In order to achieve this, the opening is arranged in a side portion of the yarn spool handling container with a minimum axial extension according to the laying width of the yarn. Additionally, the opening can also extend at least partially in the region of the front face of the yarn spool handling container turned towards the yarn spooling machine. It is also possible that an opening extends continuously from an aperture of the one front face of the yarn spool handling container over the side portion up to an aperture of the other front face of the yarn spool handling container. It is furthermore possible for the opening to be open only temporarily, especially during winding and unwinding, while being closable to avoid e.g. an entering of dirt, especially during the transport and/or the stocking. The closing can be achieved by a closing plate or a closing flap or by a cover such as a tarpaulin or film.

For the case that it is to be made certain that during the handling there is no unintended unwinding of the yarn, the invention proposes that there a brake device is provided in the yarn spool handling container. A "brake device" in the sense of the invention includes a friction-locking brake device as well as a form-locking brake device which can also be realized as a latching, snapping or locking device. The brake device is effective between frame or housing and spindle or a sleeve possibly arranged on the spindle.

Preferably, the brake device is active during a transport of the yarn spool handling container. It is also possible, however, that the brake device is used to achieve a braking of the yarn spool at the end of the spooling process.

The actuation of the mentioned brake device can be done in any way. To mention only some non-limiting examples, the actuation of the brake device can be done manually by the operator. The actuation of the brake device by an actuator is also possible, which can be controlled, for example, by a control device of the yarn spooling machine and/or a control device of the yarn spool handling container. It is also possible that the brake device is released in a force-controlled way when a drive torque is applied onto the spindle by the yarn spooling machine which surpasses a given threshold torque which is larger than possible torques active during the handling which are responsible for an unintended unwinding of the yarn. For a special proposition according to the invention, however, the brake device is actuatable in a motion-controlled way, where as "actuating" an activating of the brake device and/or a releasing of the brake device is understood. To mention only a non-limiting example for such a motion-control of the brake device, when the yarn spool handling container is not coupled to the yarn spooling machine, for example, the brake device can be activated by a spring. When the yarn spool handling container approaches the yarn spooling machine (possibly simultaneously with coupling the spindle coupling element to the yarn spooling machine coupling element), the brake device can be automatically released in a motion-controlled way during the approaching movement, in which way a spooling process is enabled. The corresponding applies when the yarn spool handling container approaches the yarn spooling machine for guaranteeing an unspooling. This embodiment has the advantage that at the removal of the yarn spool handling container from the yarn spooling machine or a device for unspooling the brake device is automatically actuated. The brake device is then also active during the transport or the stocking of the yarn spool handling container. It is also possible that the motion-controlled actuation of the brake device also takes place when putting the yarn spool handling container on the ground. This is e. g. achieved by an actuation cam which is actuated in the region of the contact surface by the putting down, which then activates or deactivates the brake device.

The spindle can be supported in any way with respect to the frame or housing. It is possible that the spindle is only supported on the frame or housing on one side of the yarn spool (with any number and arrangement of the bearings on this side of the yarn spool). For another embodiment of the yarn spool handling container according to the invention, however, the spindle is supported on the frame or housing on two sides of an axial segment of the spindle on which a yarn spool can be arranged or is arranged. To mention only a non-limiting example, a two-sided support of the spindle in the two end portions of the spindle can be done on the front face parts of the frame or the housing. For the case that in a yarn spool handling container several yarn spools are supported on one and the same spindle, there can also be a support of the spindle between neighboring axial segments for the yarn spools.

Generally, a yarn spool handling container according to the invention can be used for yarn spools of any mass. Preferably, however, the yarn spool handling container according to the invention is designed in such a way that it can be intended for a handling of yarn spools with a mass of the winding of more than 300 kg, especially more than 500 kg, more than 800 kg or more than 1000 kg.

A further solution of the object of the invention is given by a yarn spooling machine in which a spooling station is realized without a spindle. Such a yarn spooling machine is especially suitable for the use with a yarn spool handling container as described before. In this way, the yarn spooling machine uses the spindle of the yarn spool handling container. The transmission of the drive motion from the yarn spooling machine onto the spindle of the yarn spool handling container can then be done using the spindle coupling element and the yarn spooling machine coupling element. In this case, the winding of several yarn spools on the same yarn spooling machine is done using several yarn spool handling containers with spindles each assigned to the yarn spool handling containers. For these several spooling processes the same traversing unit (and possibly the same further devices such as a catching device, a control device, a removal device, a drive device and similar) of the yarn spooling machine can be used.

Preferably, such a yarn spooling machine has a rotary drive. The rotary drive comprises a yarn spooling machine coupling element, for example in the region of a front face of a drive spigot. The yarn spooling machine coupling element, as described before, is connectable with a spindle coupling element of a spindle, preferably of the yarn spool handling container, for the transmission of a drive torque, where this connection is releasable, which is for example achieved without tools or (as detailed before) can be achieved in a motion-controlled way.

According to a further yarn spooling machine according to the invention, this yarn spooling machine has a supporting portion or holding portion for supporting or holding a yarn spool handling container on the yarn spooling machine and/or a guiding unit for guiding a yarn spool handling container with respect to the yarn spooling machine. For the supporting portion and the guiding unit generally the things said in relation to the supporting portion or holding portion and the guiding unit of the yarn spool handling container apply. It is also possible, for example, that a guiding unit of the yarn spooling machine is realized with a kind of guided carriage onto which a yarn spool handling container is put, especially with an exact position determination by corresponding protrusions, centering pins or other centering devices. By the carriage then the yarn spool handling container can be made to approach the yarn spooling machine and the drive spigot of the rotary drive of the yarn spooling machine.

Within the framework of the invention, the yarn spooling machine can comprise an empty accommodating space located at the side of a traversing unit, in the region of which a yarn spool handling container can be arranged for each spooling process.

In so far as with the yarn spooling machine a yarn spool handling container is to be used which comprises a brake device, the invention proposes equipping the yarn spooling machine with a brake actuation device by means of which the brake device of the yarn spool handling container is actuatable. If the brake device of the yarn spool handling container is, for example, actuated in a motion-controlled way, the brake actuation device can be realized as an actuating pin, which when the yarn spool handling container approaches the yarn spooling machine exerts a releasing or activating force onto the brake device.

For the case that a yarn spooling machine is to be used for a yarn spool handling container in which at the same time several yarn spools can be wound, the invention suggests that in the yarn spooling machine with an accommodating space kept open for a yarn spool handling container several traversing units are arranged, where one each of these traversing units is responsible for the winding of a yarn spool.

Preferably, the yarn spooling machine is designed and intended for a handling of yarn spools with a mass of the winding of more than 300 kg, especially more than 500 kg or more than 800 kg. The yarn spool can have a drive and a control which guarantees a constant feeding and winding speed of the yarn independently of the diameter of the winding, where the feeding and winding speed of the yarn is preferably larger than 40 m/min.

A further solution of the object of the invention is given by a yarn spooling machine assembly in which a yarn spooling machine of the kind explained before is used together with at least one yarn spool handling container of the kind explained before.

A further solution according to the invention relates to a method for handling a yarn spool. Preferably, this is a yarn spool with a mass of the winding of more than 300 kg, especially more than 500 kg or more than 800 kg.

In this method, in a first method step, a yarn spool handling container is provided in the region of the yarn spooling machine.

In a further method step the spindle coupling element of the yarn spool handling container is coupled to the yarn spooling machine coupling element with the aim of producing a drive-torque-fixed connection, which can e.g. be achieved in a motion-controlled way as this has been explained before.

In the next method step the yarn spool is wound on a spindle of the yarn spool handling container.

When the yarn spool is completely wound, the coupling of the spindle coupling element of the yarn spool handling container with the yarn spooling machine coupling element is released.

Finally, the yarn spool handling container with the yarn spool wound within it is transported away from the yarn spooling machine, for example for a further processing, for transport or for stocking.

It is possible that the mentioned method steps are also executed in a changed sequence or simultaneously. For example, the establishment of the coupling of the spindle coupling element of the yarn spool handling container to the yarn spooling machine coupling element can be done in a motion-controlled way simultaneously with the provision of the yarn spool handling container in the region of the yarn spooling machine. Correspondingly, the release of the mentioned coupling can be carried out during the transport of the yarn spool handling container with the yarn spool wound therein away from the yarn spooling machine.

It is possible that during the mentioned method steps supporting portions or holding portions, handling portions, coupling portions or guiding portions of the frame or the housing of the yarn spool handling container and/or the yarn spooling machine are used. During the approaching of the yarn spool handling container at the yarn spooling machine, the yarn can be fed through an opening of the housing or a frame of the yarn spool handling container and/or a traversing unit can enter into such an opening of the frame or housing of the yarn spool handling container.

In a further embodiment of the method according to the invention there is an actuation of the brake device of the yarn spool handling container, which can especially be achieved in a motion-controlled way with the provision of the yarn spool handling container in the region of the yarn spooling machine, with the establishment of the coupling between the spindle coupling element and the yarn spooling machine coupling element, the begin and/or the end of the spooling process of the yarn spool, the release of the coupling and/or the transporting away of the yarn spool handling container.

In a further embodiment of the inventive method, subsequently several yarn spools are wound in yarn spool handling containers. The yarn spool handling containers are then stocked in a stocking device, which can for example be achieved by stacking of yarn spool handling containers one onto the other and/or arranging of yarn spool handling containers one beside the other. Here, it is also possible that the yarn spool handling containers then can be coupled with each other via suitable coupling portions and/or coupling elements.

For a special proposition of the invention, in a further method step the yarn spools (which are arranged in the yarn spool handling containers, which in turn are stocked in the stocking device) are rotated. Such a rotating can be done manually. The rotation can be induced intermittently or continuously. The application of the rotary motion of the yarn spools can also be achieved via the spindle coupling element or with another application of a rotary motion. Such a rotary motion of the yarn spools during the stocking is applied with the aim that gravitational forces are not continuously effective onto the winding in one circumferential portion but to have them wander in the circumferential direction with the rotation of the yarn spools.

For a further embodiment, in this method the yarn is not taken from the yarn spool handling container for a further use but rather wound off of the yarn spool in the yarn spool handling container.

It is also possible that the yarn spool is transported in the yarn spool handling container, which can also be done in a land vehicle, a water vehicle or by means of an airplane.

The yarn spool handling container can be used for a stocking device for yarn spools which are especially yarn spools with a mass of the winding of more than 300 kg, especially more than 500 kg or more than 800 kg. Such a stocking device can for example be arranged on a site of manufacture, on a site of processing, on a site of storage, on a vehicle, on a ship, on a train or on an airplane.

In the stocking device, the yarn spools are each arranged in yarn spool handling containers. The stocking device is formed with an arrangement of the yarn spool handling containers in rows and/or stacks of the yarn spool handling containers one on the other.

It is also possible that the stocking device comprises a rotating device. With the rotating device, the yarn spools are rotatable in the yarn spool handling containers. The rotating of the yarn spools can be done successively one after the other, for example by a rotary drive successively engaging with the respective spindle coupling elements of the yarn spool handling containers and in each case inducing a rotary motion around a given rotary angle. It is also possible, however, that in the yarn spool handling containers the spindle coupling elements, spindles or yarn spools are coupled with each other in such a way that they can be rotated together. For example, the rotating device can be formed with a chain or a toothed rack which comes into interaction with the outer surface of the spindle, a drive element of the spindles or the spindle coupling element in such a way that a movement of the chain or toothed rack results in the common rotation of all yarn spools.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if a bearing is mentioned, this is to be understood such that there is exactly one bearing or there are two bearings or more bearings. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION OF

Figure 1:
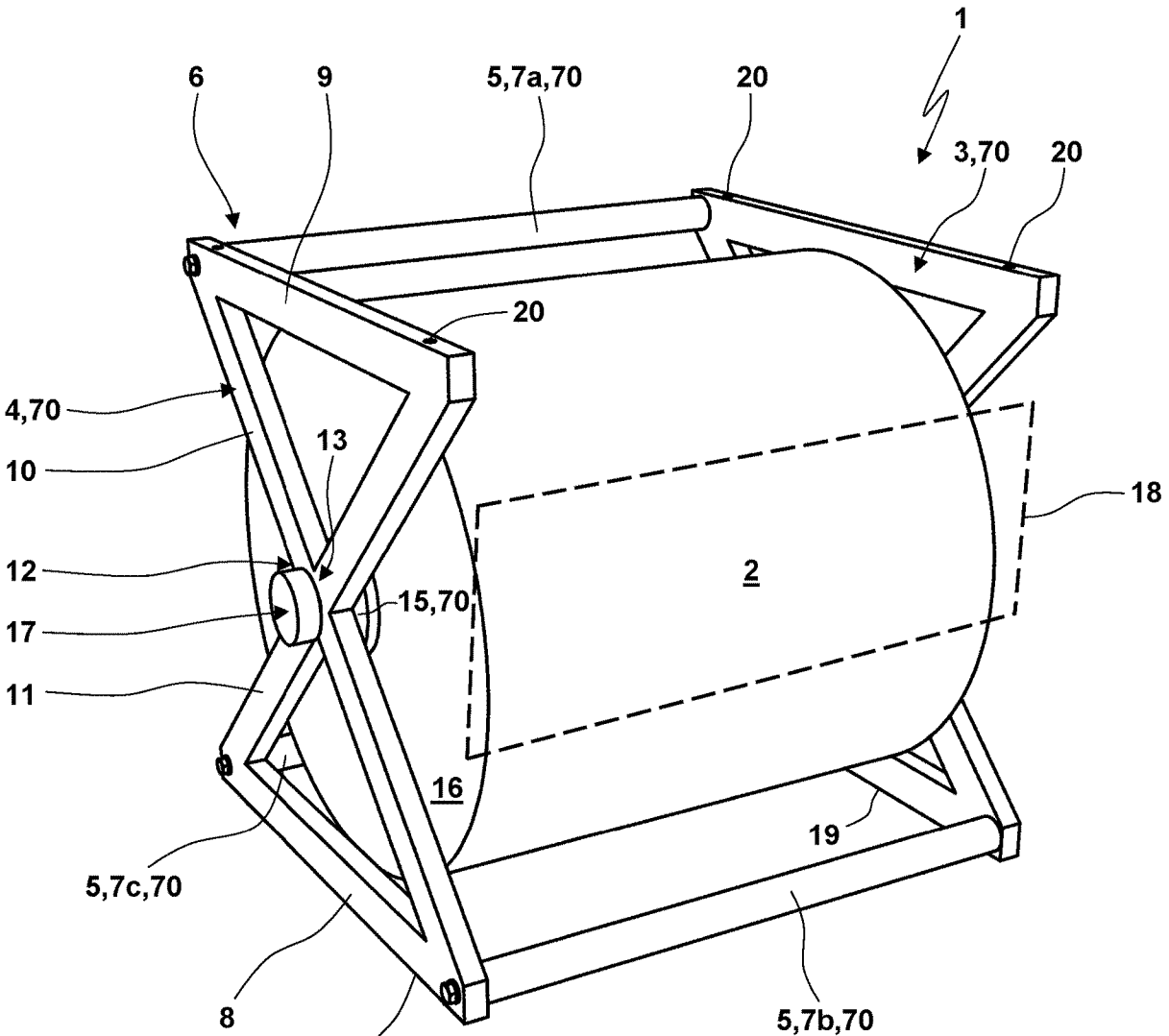
FIG. 1 in a three-dimensional representation shows a yarn spool handling container with a yarn spool.

FIG. 1 shows a yarn spool handling container 1 with a yarn spool 2. The yarn spool handling container 1 is formed with two front face parts 3, 4 and side parts 5. The front face parts 3, 4 and the side parts 5 form a housing or a frame 6. In a first rough approximation, the housing or the frame 6 is cube-shaped, where for the embodiment shown the frame or the housing are realized in a "skeleton-like way" with large opening, which serves especially for reducing weight. For the embodiment shown, the side parts 5 are formed with side trusses 7*a*, 7*b*, 7*c* which here are rod-shaped, realized as a solid profile or hollow profile or as a circular profile. The side trusses 7 are arranged in the region of the longitudinal edges of the cube-shaped housing or frame 6. It is possible that in the region of a side edge of the cube-shaped housing or frame 6 no side truss 7 is arranged (cp. FIG. 1). The side trusses 7 on their front faces are each screwed to the front face parts 3, 4, in which way the housing or the frame 6 is realized as inflexible. For the embodiment shown, the front face parts 3, 4 are formed with a horizontal lower truss 8, a horizontal upper truss 9 and connecting trusses 10, 11 forming an "X", which connect opposing end portions of the trusses 8, 9. In the crossing portion of the connecting trusses 10, 11, a bearing portion 12 is formed which can be reinforced or widened. In each of the bearing portions 12 of the front face parts 3, 4, a spindle 15, which extends through the yarn spool 2, is supported via bearings 13, 14. A winding 16 can be wound directly onto the spindle 15 or by interposition of a yarn spool body such as a sleeve. With one or both end portions the spindle 15 extends through the bearing portion 12 of at least one front face part 3, 4. The end portion of the spindle 15 protruding outwards from the front face part 4 forms a spindle coupling element 17, which in FIG. 1 is only schematically shown. The housing or the frame 6 form an opening 18 to the side of the yarn spool 2 at the level of the longitudinal and rotational axis 53 of the spindle 15 through which the yarn spool 2 and, without a winding 16, the spindle 15 are freely accessible. On the side turned towards the floor, the undersides of the front face parts 3, 4 (and possibly also of the side parts 5) form a supporting portion 19. It is also possible that in the supporting portions 19 protrusions 37 or indentations are provided. On the upper side, the front face parts 3, 4 (and possibly also the side parts 5) have openings 20 for the embodiment shown. If several yarn spool handling containers 1 are stacked one on the other, protrusions 37 in the supporting portions 19 of a second yarn spool handling container 1 arranged above a first yarn spool handling container 1 can form-lockingly engage with the openings 20 of the first yarn spool handling container 1 arranged below it.

Figure 2:
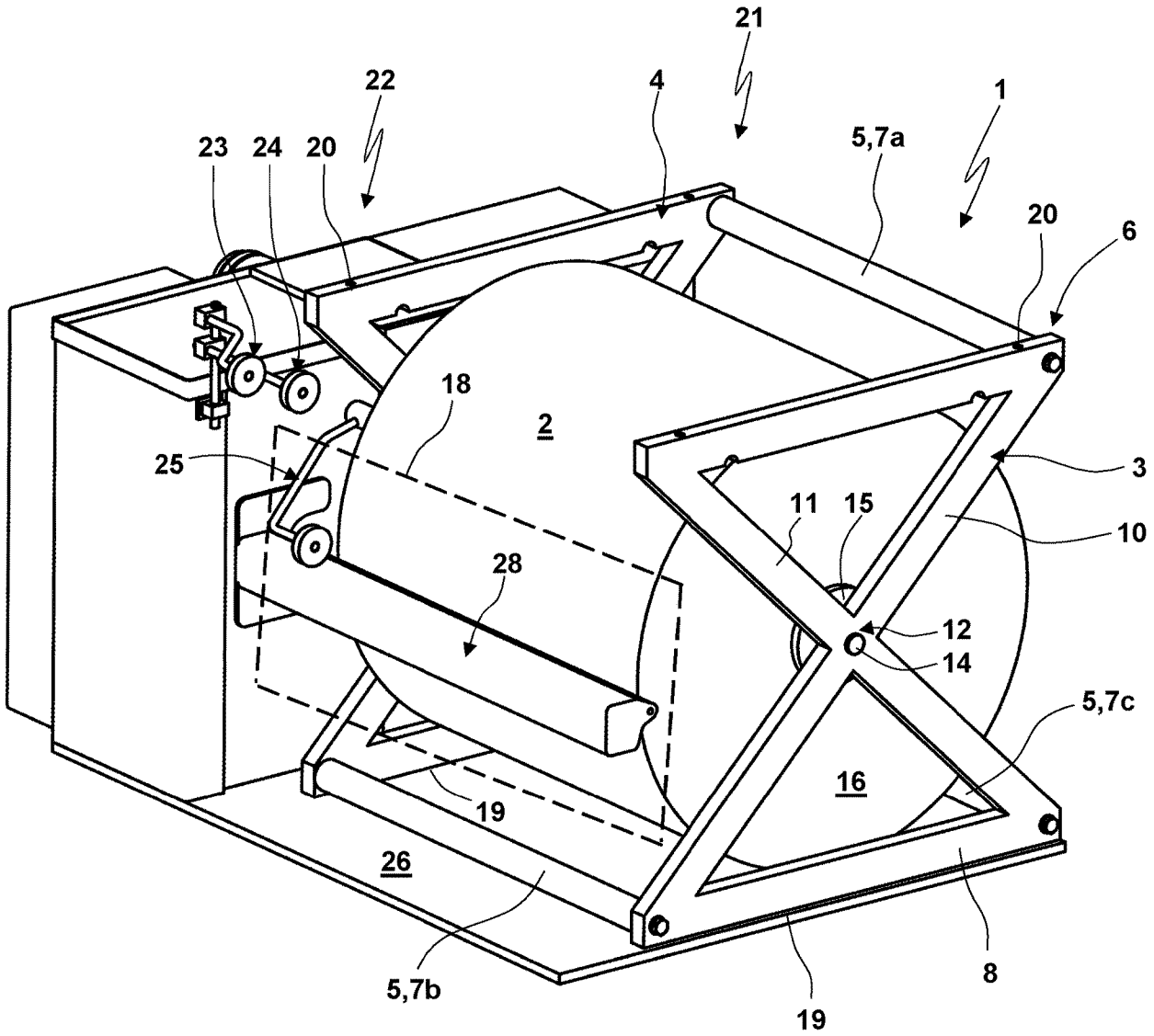
FIG. 2 in a three-dimensional representation shows a yarn spooling machine assembly with a yarn spooling machine and a yarn spool handling container.

FIG. 2 shows a yarn spooling machine assembly 21. The yarn spooling machine assembly 21 is formed with a yarn spool handling container 1 according to FIG. 1 and a yarn spooling machine 22 which here is realized only with a spooling station to simplify the representation. In FIG. 2, the yarn spooling machine 22 is only schematically shown. It can, however, be seen that the yarn spooling machine 22 is formed with a traversing unit 28 and a feeding device for the yarn which comprises several rolls and dancer arms 23, 24, 25. The yarn spooling machine 22 comprises a supporting portion 26. It is possible that the yarn spool handling container 1 stands on the supporting portion 26 of the yarn spooling machine 22 with the supporting portion 19. There can be a centering and/or a form-locking securing of the position of the yarn spool handling container 1 relative to the yarn spooling machine 22 by interaction of protrusions 37 and indentations in the supporting portions 19, 26.

As will be explained in more detail in the following, the spindle coupling element 17 is coupled rotationally fixedly with the yarn spooling machine coupling element 27 so that a drive of the yarn spooling machine 22 can induce the rotation of the spindle 15 and the yarn spool 2 of the yarn spool handling container 1. In this way, for the yarn spool machine assembly 21 by operating the yarn spool machine 22, that is, driving the yarn spooling machine coupling element 27 and feeding and laying of the thread via the rolls and dancer arms 23 to 25 and the traversing unit 28 a winding 16 of the yarn spool 2 can be produced. After completing the winding 16, the yarn spool handling container 1 with the housing or frame 6 and the spindle 15 and the yarn spool 2 is removed from the yarn spooling machine 22.

Figure 3:
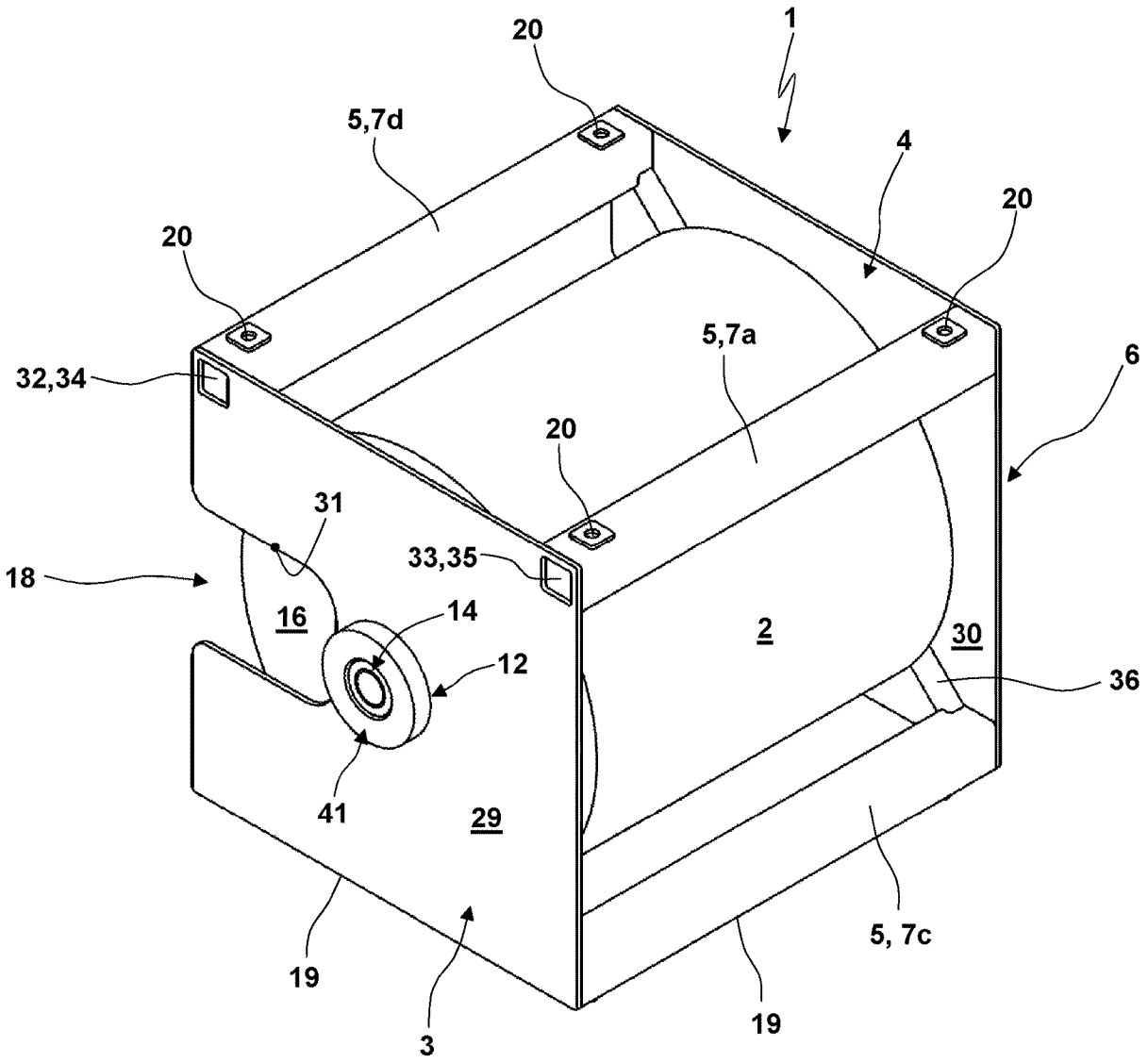
FIG. 3 in a three-dimensional representation shows a further yarn spool handling container with a yarn spool.

FIG. 3 shows an alternative embodiment of a yarn spool handling container 1 in which all side edges of the housing or frame 6 that in a first approximation is cuboid are formed with side trusses 7*a*, 7*b*, 7*c*, 7*d*. The front face parts 3,4 are formed with massive plates 29, 30, which are generally rectangular or square and in the region of their corners are connected to the side trusses 7. For this embodiment, the opening 18 arranged on the back side in FIG. 3 does not only extend in the side portion of the cuboid housing or frame 6. Rather than that, the plates 29, 30 here have U-shaped cutouts 31 which extend outwards from the bearing portion 12 at the level of the rotational axis of the spindle 15. It can be seen in FIG. 3 that the plates 29, 30 can have openings 32, 33 which possibly open into openings or a hollow interior of the side trusses 7. With these openings 32, 33, handling portions 34, 35 are formed which enable the handling of the yarn spool handling container 1. For example, into the handling portions 34, 35 supporting pins can be inserted by means of which a lifting of the yarn spool handling container 1 is possible. In FIG. 3 it can also be seen that additional stiffening trusses 36 can be present. These stiffening trusses 36 serves especially for the stiff support of the bearing portion 12 for the bearings 13, 14.

Figure 4:
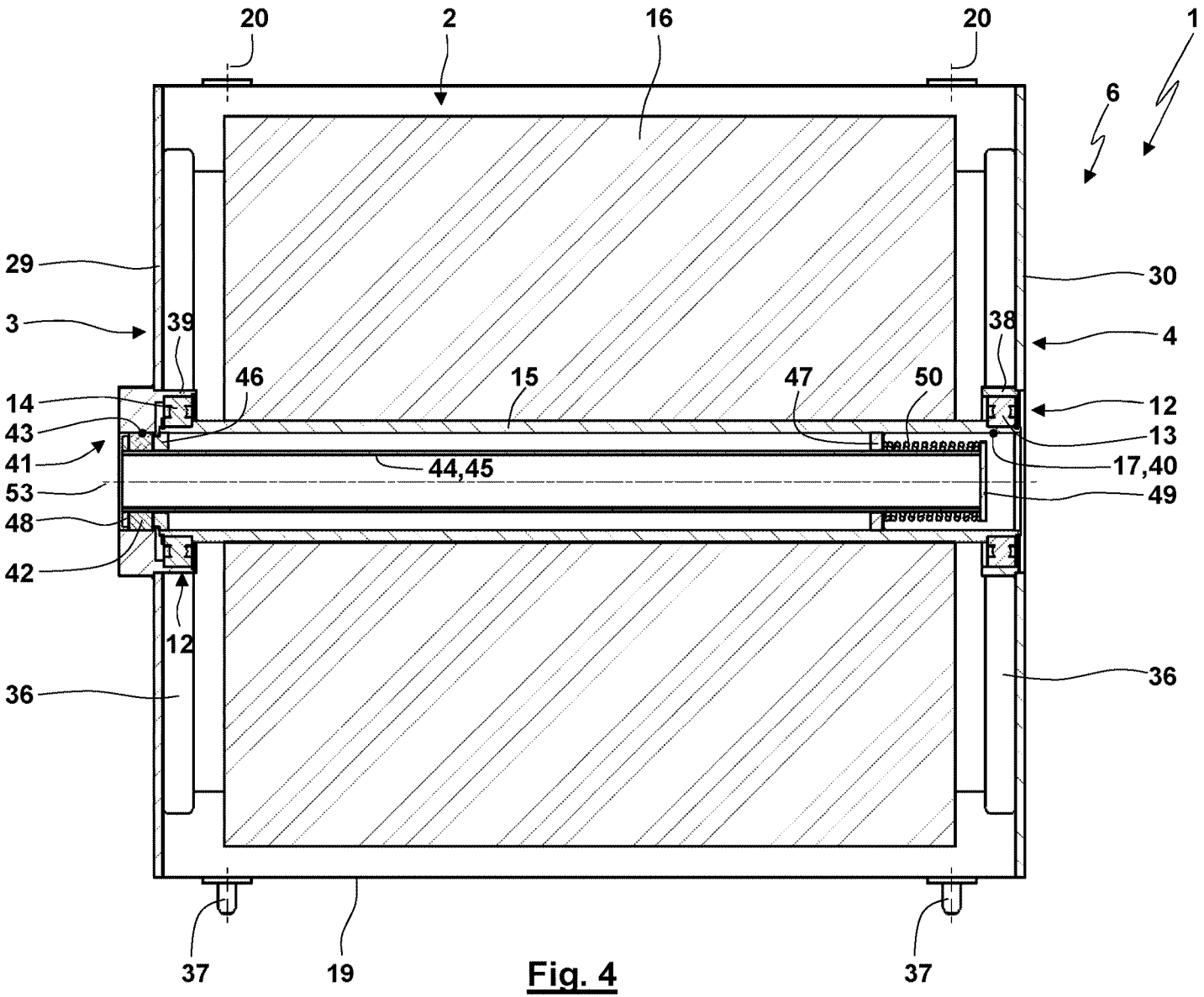
FIG. 4 in a longitudinal section shows the yarn spool handling container with a yarn spool according to FIG. 3.

In FIG. 4 the protrusions 37, here pins, can be seen in the supporting portion 19. The protrusions 37 can serve for guaranteeing a form-locking, position-accurate arrangement of the yarn spool handling container 1 in the supporting portion 26 of the yarn spooling machine 22 or on a carriage 6, in order to achieve which the protrusions 37 enter into openings of the supporting portion 26 of the yarn spooling machine 22 or the carriage 63 with a corresponding cross section. If for the stocking or during a transport several yarn spool handling containers 1 are stacked one on the other, the protrusions 37 of one yarn spool handling container 1 can enter into the openings 20 on the upper side of a yarn spool handling container 1 arranged below.

In the longitudinal section according to FIG. 4 it can be seen that the bearing portions 12 for the bearings 13, 14 are formed with bearing rings 38, 39, which are welded together with the front face parts 3, 5, the plates 29, 30, the connecting trusses 10, 11 and/or the stiffening trusses 36, are integrally formed by the mentioned elements or in other way are fixedly connected to the mentioned elements. On a hollow cylindrical interior surface of the bearing rings 38, 39 on the radially outer side the bearings 13, 14 are supported. On the radially inner side, the spindle 15 in its end regions is supported on the bearings 13, 14. For the embodiment shown, the spindle coupling element 17 is realized with a hollow cylindrical interior surface 40 of the spindle 15. For the embodiment shown, the spindle 15 is realized as a hollow shaft. As will be explained in more detail in the following, a friction-locking transmission of a drive torque onto the spindle 15 via the spindle coupling element 17 is achieved by a drive spigot 52 of the yarn spooling machine 22 or a friction element 58 of the drive spigot 52 being pressed against the cylindrical interior surface 40 of the spindle 15 in a radially outwards direction.

As an optional further component, FIG. 4 shows a brake device 41 of the yarn spool handling container 1. For the embodiment shown in FIG. 4, the brake device 41 is formed with an elastic friction body 42, which rotates with the spindle 15 and can be tensioned against the frame or the housing 6, which here is represented by a hollow cylindrical interior surface 43 of the bearing ring arranged axially besides the bearing 14, to produce a braking effect. In order to achieve this, radially on the inner side of the spindle 15 realized as a hollow shaft an actuation element 44, which here also is a hollow shaft 45, is guided to be slidable axially. For the embodiment shown, the guiding of the hollow shaft 45 is achieved via the guiding rings 46, 47 fixed to the spindle 15 with a distance in the interior of the spindle 15. In the end region protruding outwardly from the guiding ring 46, the hollow shaft 45 supports the elastic friction body 42 which here also is realized as a ring body. The elastic friction body 42 on the outer side is supported on a supporting ring 48 which is supported by the hollow shaft 45. In the opposite end portion, the hollow shaft 45 supports a contact and supporting disc 49. Between the guiding ring 47 and the contact and supporting disc 49, a brake spring 50 surrounding the hollow shaft 45 on the radially outer side is captured. The brake spring 50 is pretensioned in such a way that it biases the hollow shaft 45 in such a way that via the supporting ring 48 the elastic friction body 42 is pressed against the guiding ring 46 and is elastically deformed in such a way that the elastic friction body 42 expands radially outwardly, in which way it is pressed against the hollow cylindrical interior surface 43 of the bearing ring 49 to produce the braking effect. If with the approach of the yarn spool handling container 1 to a drive spigot 52 of a yarn spooling machine 22 the drive spigot 52 enters into the interior of the spindle 15, the drive spigot presses the contact and supporting disc 49 and therefore the hollow shaft 45, the supporting ring 48 and the elastic friction body 42 to the left in FIG. 4 against the biasing by the brake spring 50. With the motion induced in this way, the elastic friction body 42 relaxes, in which way the friction force between the elastic friction body 42 and the interior surface 43 of the bearing ring 39 is decreased and removed and the brake device 41 is released. The entering of the drive spigot 52 for releasing the brake device 41 can at the same time be used to induce the drive-torque-fixed connection between the drive spigot 52 and the spindle 15 via the coupling of the spindle coupling element 17 to the yarn spooling machine coupling element 27.

Figure 5:
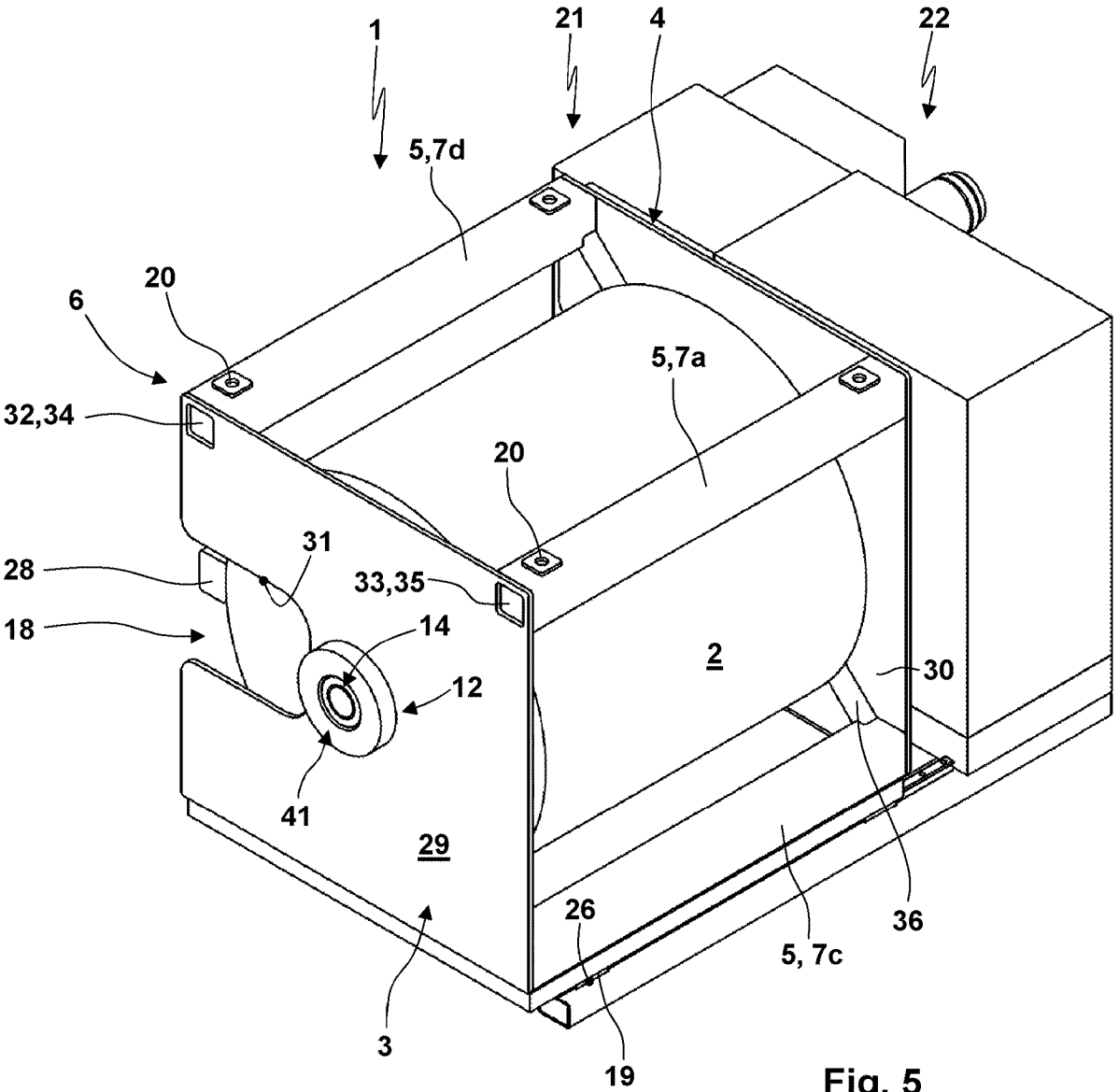
FIG. 5 in a three-dimensional representation shows a yarn spooling machine assembly with a yarn spool handling container according to FIGS. 3 and 4 and a yarn spooling machine.
Figure 6:
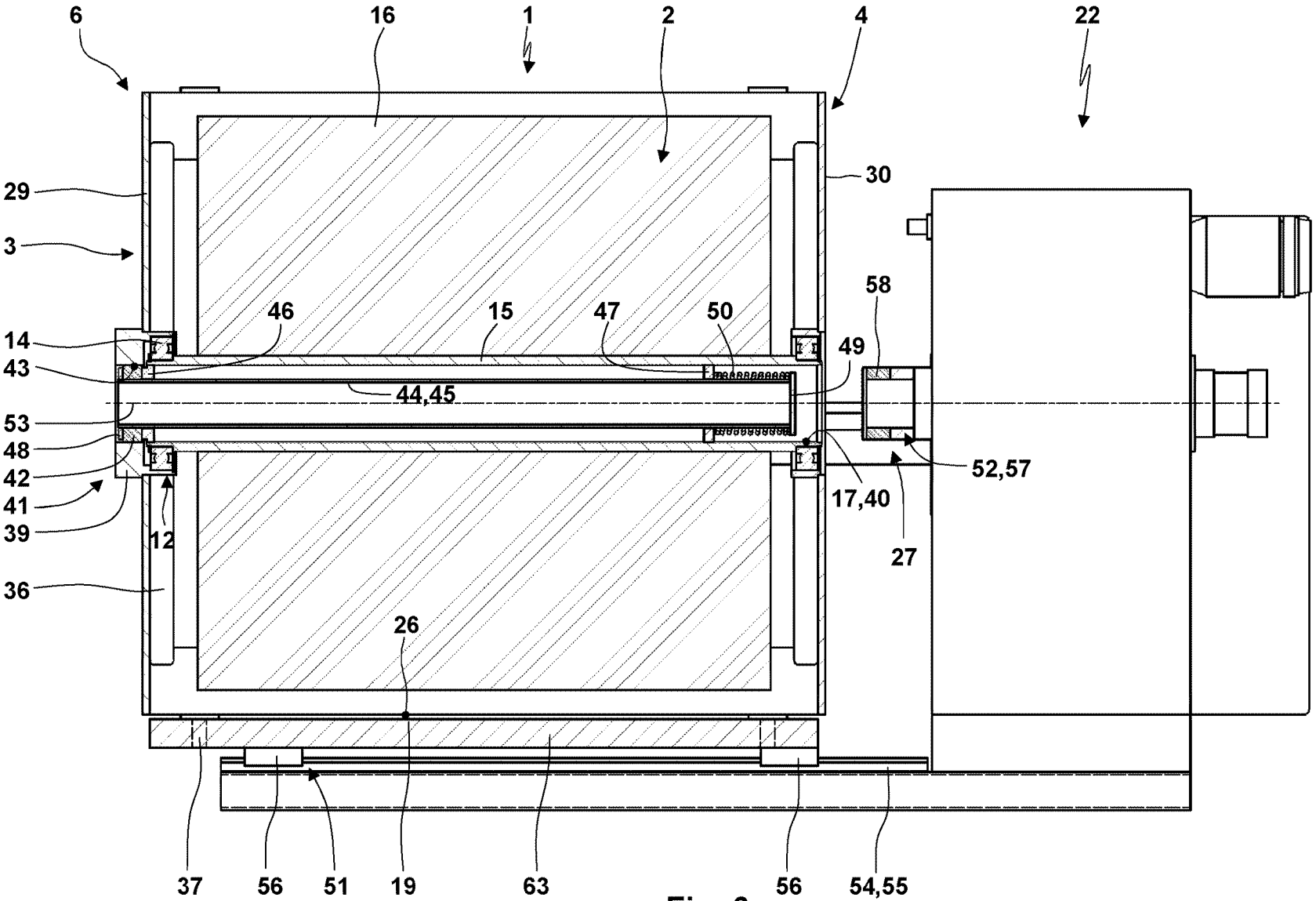
FIG. 6 shows the yarn spooling machine assembly according to FIG. 5 with a partial longitudinal section before the approach and coupling of the yarn spool handling container to the yarn spooling machine.
Figure 7:
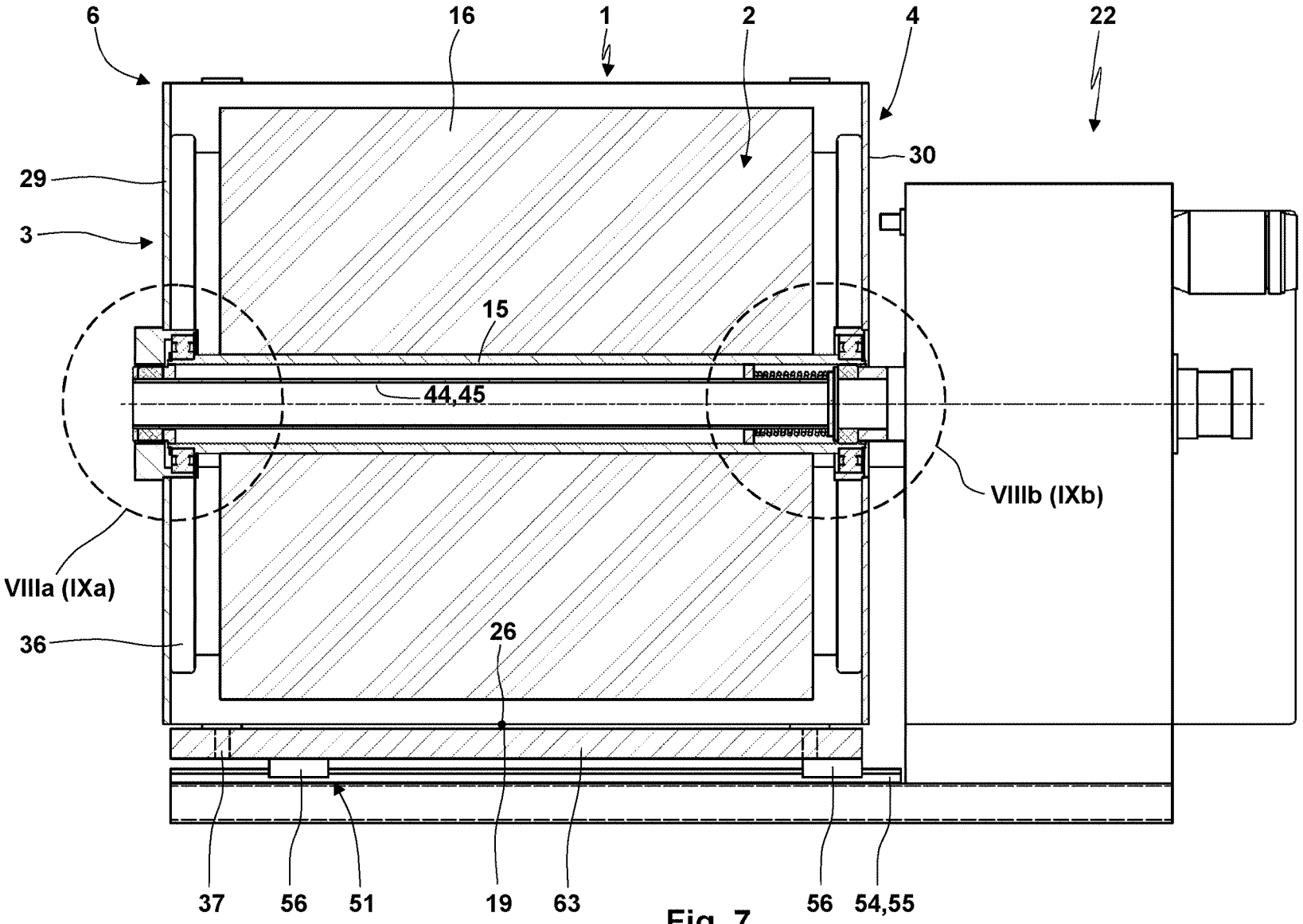
FIG. 7 shows the yarn spooling machine assembly according to FIGS. 5 and 6 with a partial longitudinal section after the approach and coupling of the yarn spool handling container to the yarn spooling machine.

FIG. 5 in a spatial representation shows the yarn spooling machine assembly 21 with the yarn spooling machine 22 and the yarn spool handling container 1, where FIGS. 6 and 7 show the yarn spooling machine assembly 21 in a partial longitudinal section; that is, FIG. 6 before the release of the brake device 41 and before the coupling of the spindle coupling element 17 to the yarn spooling machine coupling element 27 and FIG. 7 after the release of the brake device 41 and after the coupling of the spindle coupling element 17 to the yarn spooling machine coupling element 27.

During the approach of the yarn spool handling container 1 to the yarn spooling machine 22, the guiding of the yarn spool handling container 1 is done by a guiding device 51. By means of the guiding device 51, the yarn spool handling container is guided in such a way that the approach to the yarn spooling machine 22 is achieved with a coaxial alignment of the drive spigot 52 of the yarn spooling machine 22 to the longitudinal and rotational axis 53 of the spindle 15. It is possible that the guiding device 51 comprises two guiding units 54 which here are realized as a guiding rail 55. The guiding rails 55 are oriented in parallel to the rotational axis of the drive spigot 52. The yarn spool handling container 1 in its supporting portion 19 can comprise four guiding units 56. Two guiding units 56 each are assigned to one guiding rail 55. The guiding units 56 in a form-locking way wrap around the guiding rail 55, so that a guiding of the motion of the yarn spool handling container 1 relative to the yarn spooling machine 22 is achieved. For the embodiment shown, however, the yarn spooling machine 22 has a carriage 63 on the underside of which the guiding units 56 are arranged and come into interaction with the guiding rails 55. The yarn spool handling container 1 is supported on the carriage 63 with the supporting portion 19, where a centering or a form-locking securing of the position can be achieved by the protrusions 37 of the yarn spool handling container 1 entering into corresponding openings of the carriage 63.

With the approach of the yarn spool handling container 1 to the yarn spooling machine 22, the drive spigot 52 enters into the yarn spool handling container 1, which here is the interior of the spindle 15 (see the transition from FIG. 6 to FIG. 7). This movement of the yarn spool handling container 1 is caused by an external handling device. It is also possible, however, that the yarn spool handling container 1 is only brought into effective connection with the guiding device 51 while at least a part of the approaching motion is induced by a driving device of the guiding device 51 or the carriage 63 (not shown here). With the entering of the drive spigot 52, the drive spigot 52, which therefore forms a brake actuation device 57, actuates (as explained before) the brake device 41, in which way a release of the brake device 41 occurs. Before, while or after the releasing of the brake device 41 the yarn spooling machine coupling element 27, which here is realized by the drive spigot 52, is coupled with the spindle coupling element 17. The yarn spooling machine coupling element 27 is realized as a friction element 58 which is biased radially outwardly against the hollow cylindrical interior surface 40 of the spindle 15. It is possible that the friction element 58 is also realized as an elastic friction body which is axially compressed by axial biasing via an actuator—with an accompanying radial extension. In the state induced in FIG. 7, the brake device 41 has been released and via the contact of the friction element 58 with the spindle 15 there is a drive-torque-fixed coupling of the drive spigot 52 with the spindle 15. The drive-torque-fixed coupling between the drive spigot 52 and the hollow shaft 45 can be guaranteed by the friction contact between the front face of the drive spigot 52 and the contact and supporting disc 49 and/or a form-locking of the cross sections of the hollow shaft 45 and the guiding rings 46, 47, which enables the necessary axial movement of the hollow shaft 45.

Figure 8B:
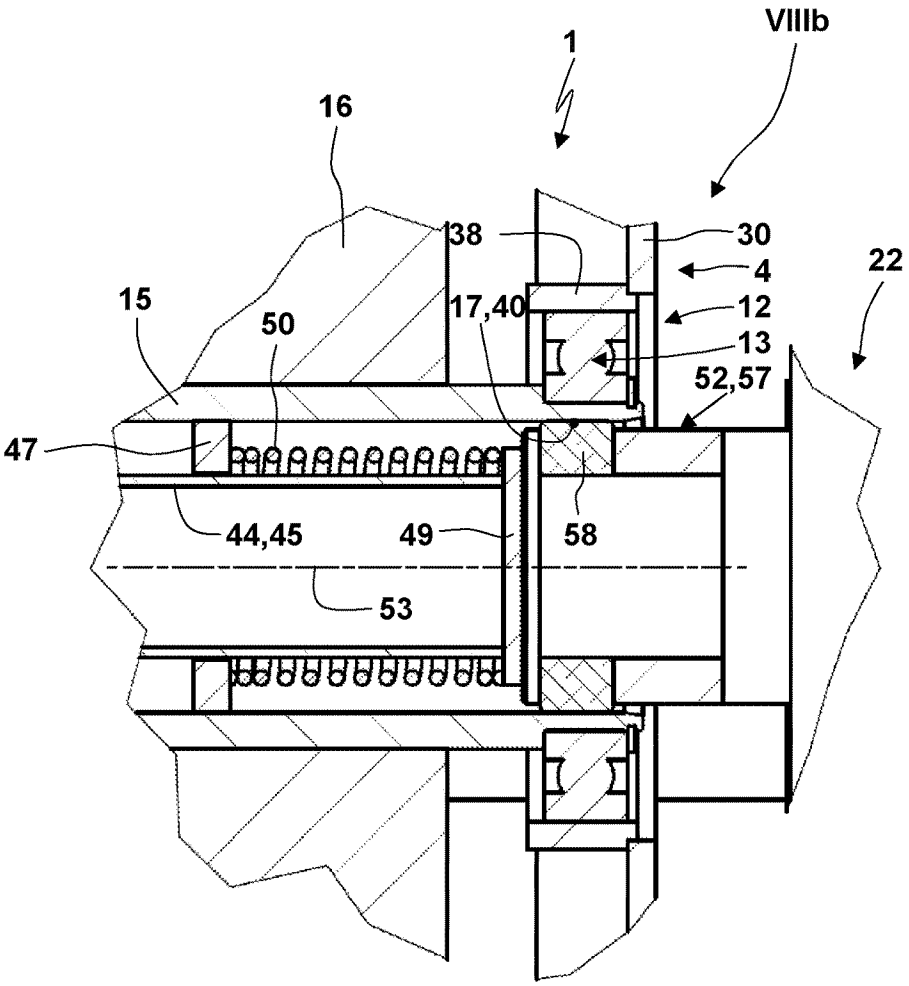
FIGS. 8A and 8B show details of the yarn spooling machine assembly according to FIG. 7 with a friction-locking brake device (detail VIIIa) and a friction-locking coupling (detail VIIIb).
Figure 8A:
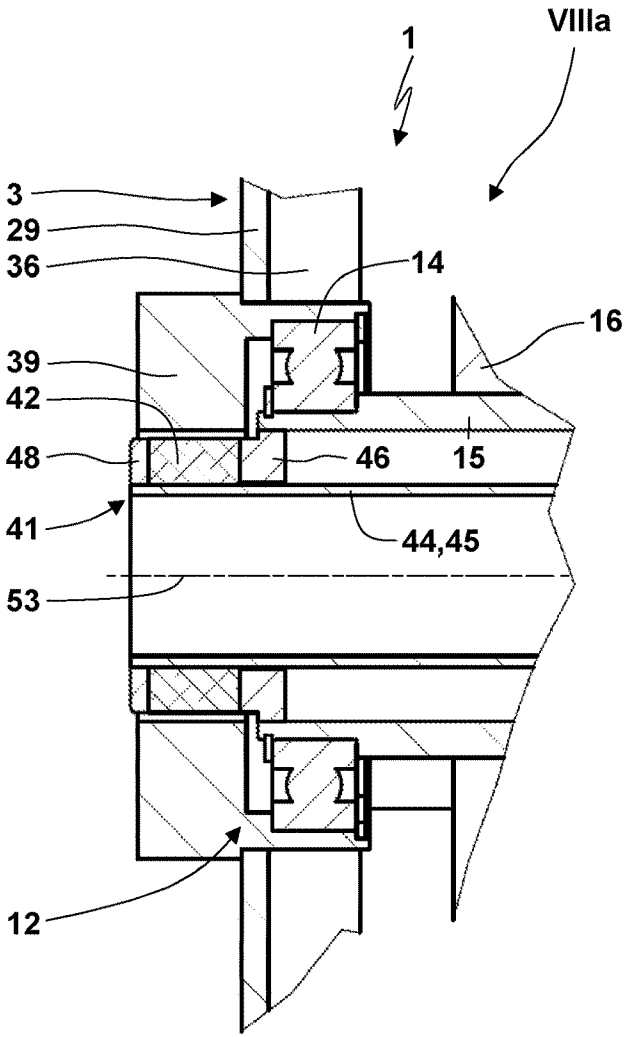
Figure 9B:
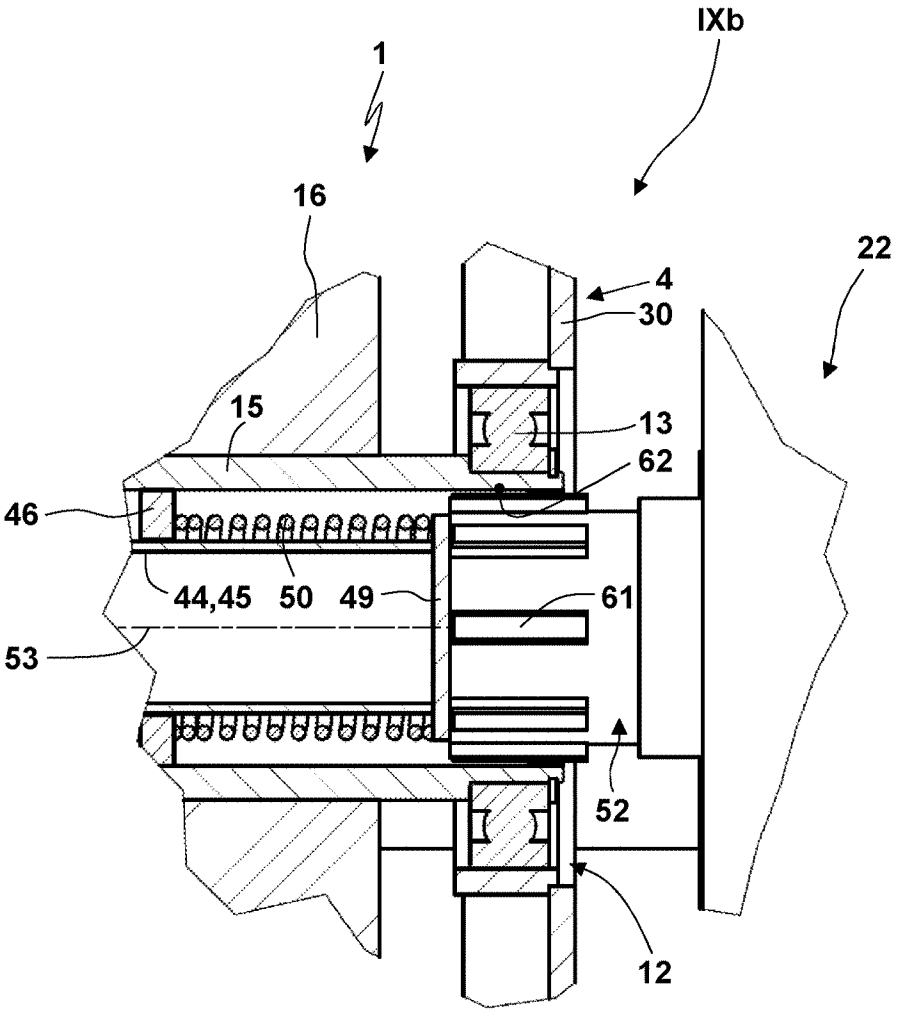
FIGS. 9A and 9B show modified details of a yarn spooling machine assembly with a form-locking brake device (detail IXa) and a form-locking coupling (detail IXb).
Figure 9A:
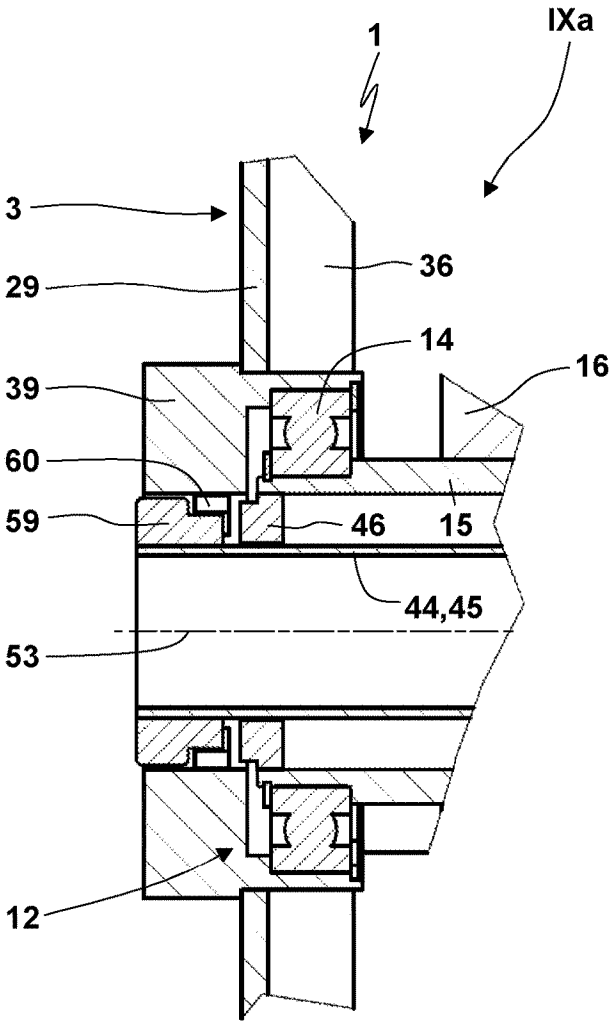

FIGS. 8A and 8B in detail show the brake device 41 with the bearing 14 between the bearing ring 39 and an end region of the spindle 15 (detail VIIIa) and the brake actuation device 57 with the bearing 13 between the bearing ring 38 and the other end portion of the spindle 15 with the spindle coupling element 17 and yarn spooling machine coupling element 27 (detail VIIIb) friction-lockingly coupled.

In a representation corresponding to FIGS. 8A and 8B, FIGS. 9A and 9B show a modified embodiment in which not a friction-locking brake device 41 is used but rather a form-locking brake device 41, which can also be referred to as a locking device (see detail IXa). In this case, the hollow shaft 45 in the end portion protruding from the guiding ring 46 instead of the supporting ring 48 and the elastic friction body 42 supports a locking body 59 the active surface of which is realized to be not round. For example, the locking body 59 can be realized with notches, protrusions or as a locking toothing. The bearing ring 39 on its radially inner side also forms a locking body 60 or supports the locking body 60. At the actuation of the brake actuation device 57, with the hollow shaft 45 the locking body 59 is pushed out of the bearing ring 39 so far that the locking bodies 59, 60 have no axial overlap, in which way there is no locking or braking and the spindle 15 is freely rotatable. Without actuation of the brake actuation device 57, that is, for the drive spigot 52 removed from the yarn spool handling container 1, the hollow shaft 45 due to the brake spring 50 presses the locking body 60 into the locking body 59, in which way a form-locking locking or braking is achieved. Possibly, the locking bodies 59, 60 can also comprise insertion bevels which enable the locking not only for defined angular alignments of the locking bodies 59, 60.

According to detail IXb, the coupling between the spindle coupling element 17 and the yarn spooling machine coupling element 27 is also form-lockingly: The yarn spooling machine coupling element 27 assigned to the drive spigot 52 is formed with protrusions, ribs, or a spline 61. Correspondingly, in the assigned end portion the spindle 15 is also realized with apertures, notches or a spline 62 in the region of an aperture or the interior surface. At the insertion of the drive spigot 52, the protrusions, indentations, ribs, notches or splines 61, 62 come into interaction in a form-locking way with the aim of forming a drive-torque-fixed connection. Insertion bevels can also be provided in this context.

In deviation to FIGS. 8A-8B and 9A-9B, it is also possible that the brake device 41 is based on a friction-locking while the coupling between the spindle coupling element 17 and the yarn spooling machine coupling element 27 is based on a form-locking (or the other way around).

Figure 10:
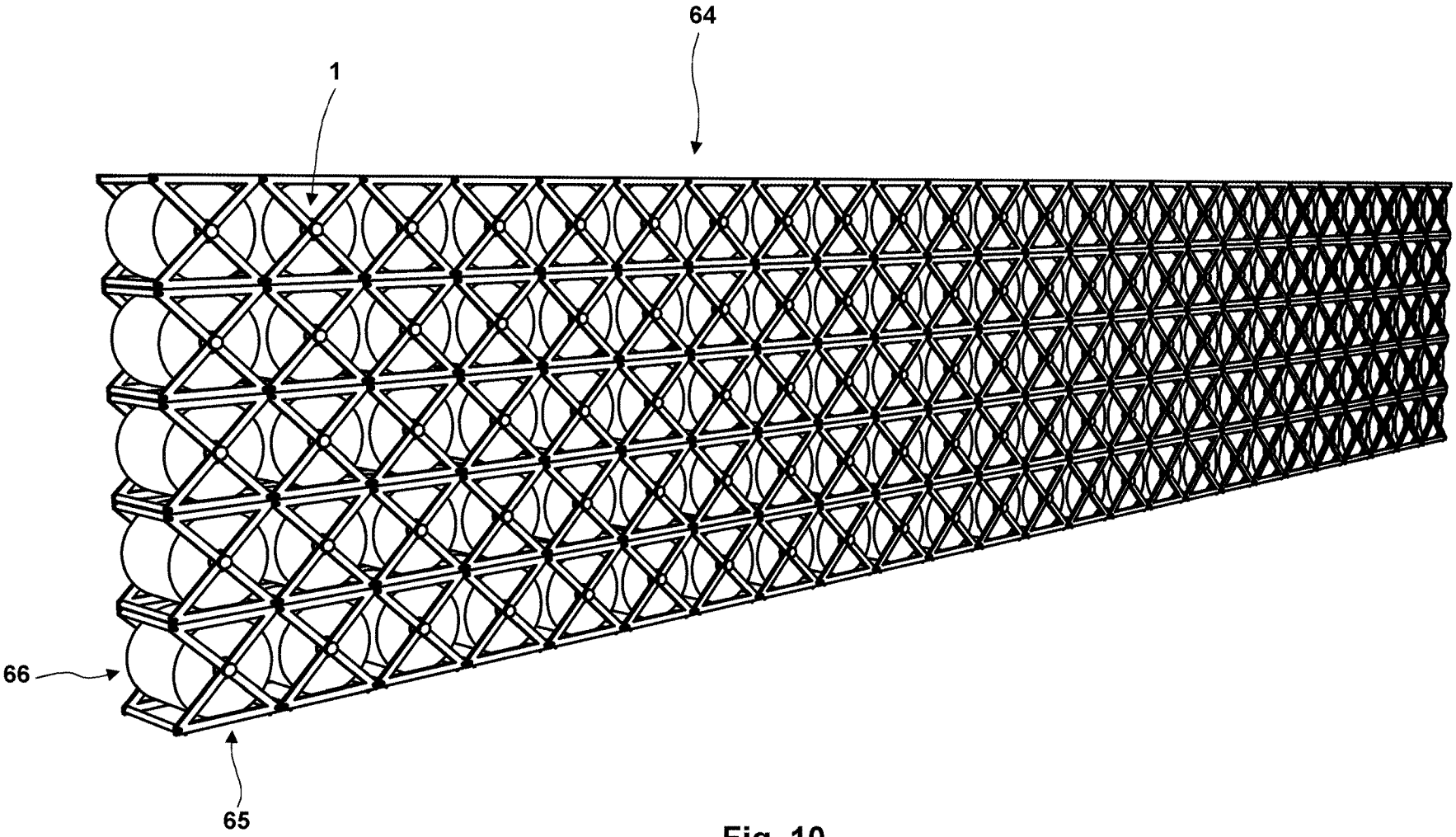
FIG. 10 in a three-dimensional representation shows a stocking device with several rows of stacked yarn spool handling containers.

FIG. 10 shows the stocking of several yarn spool handling containers 1 in a stocking device 64. Several yarn spool handling containers 1 are stacked one above the other in stacks 65, where several such stacks 65 are arranged directly neighboring each other, so that the yarn spool handling containers 1 are also arranged in several rows 66 arranged one above the other. Neighboring yarn spool handling containers 1 can be connected to each other, in order to achieve which for example protrusions 37 on the underside of a yarn spool handling container 1 can engage with openings 20 on the upper side of a yarn spool handling container 1 arranged below.

Figure 11:
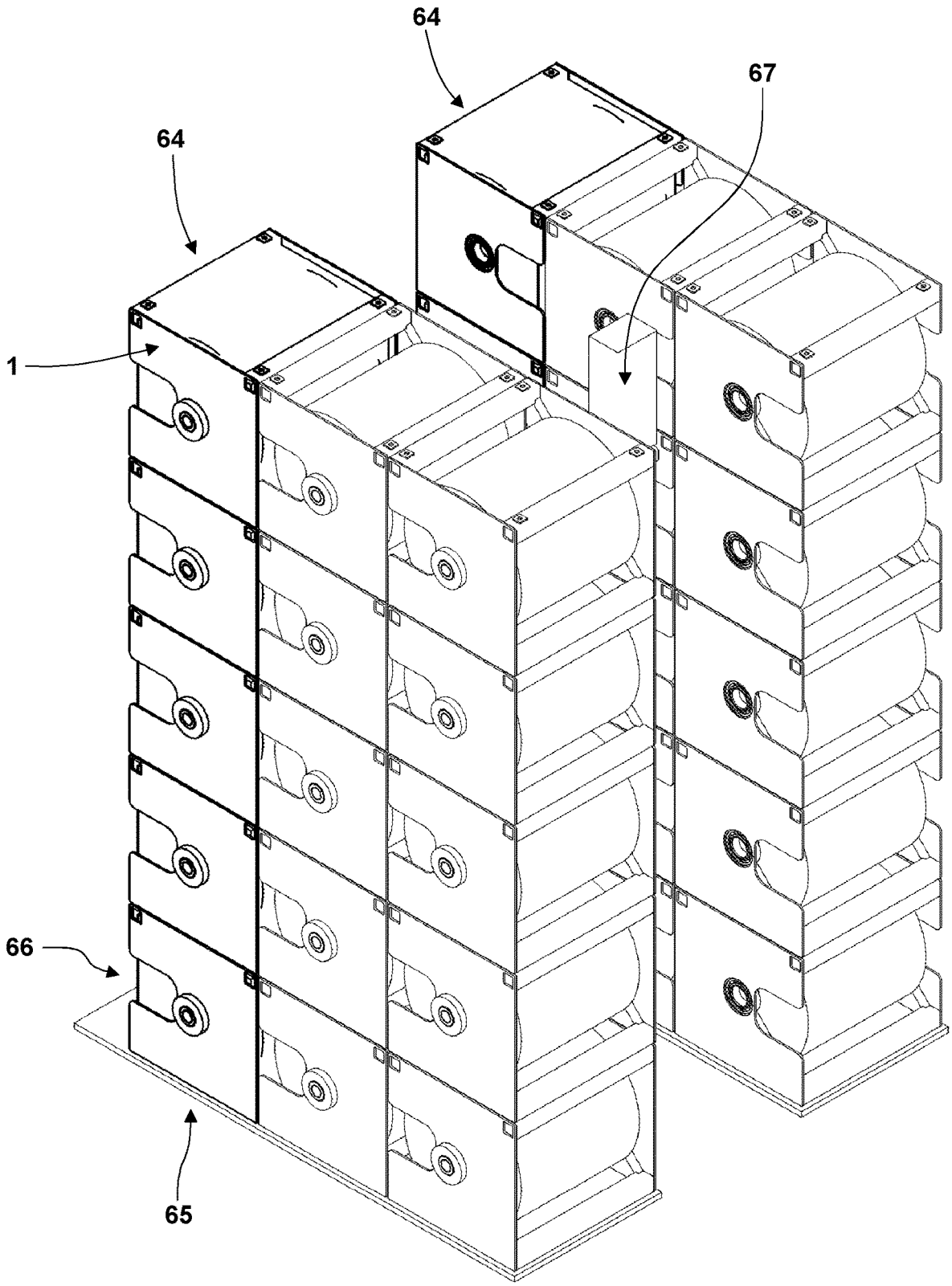
FIG. 11 in a three-dimensional representation shows a further stocking device with a rotating device.
Figure 12:
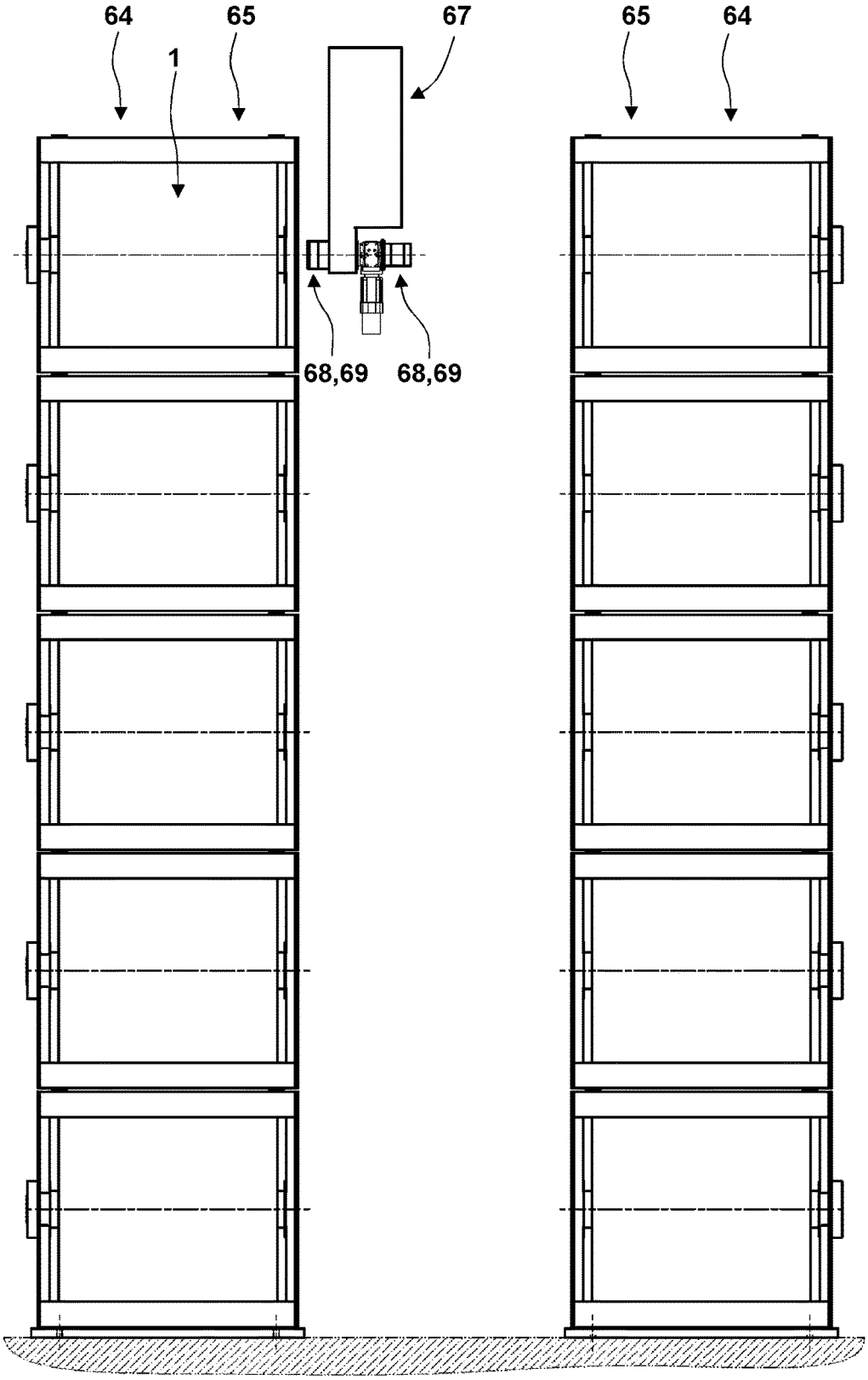
FIG. 12 in a side view shows the stocking device with the rotating device according to FIG. 11.

For the embodiment shown in FIGS. 11 and 12, in the region of the stocking device 64 a handling device or rotating device 67 is provided. The rotating device 67 comprises a drive spigot 68. The drive spigot 68 is equipped with a rotating device coupling element 69 which is preferably realized correspondingly to the yarn spooling machine coupling element 27. Via suitable actuators the rotating device 67 can be arranged in the region of each yarn spool handling container 1 of the stocking device 64. The drive spigot 68 can then be aligned coaxially to the longitudinal and rotational axis 53 of the spindle 15 of the yarn spool handling container. The drive spigot 68 then will be inserted into the yarn spool handling container 1 in such a way that the rotating device coupling element 69 is coupled with the spindle coupling element 17 in a drive-torque-fixed way (friction-lockingly or form-lockingly). With a simultaneous release of the brake device 51 of this yarn spool handling container 1 and by driving the rotating device 67 with a specified rotational angle of the drive spigot 68 there can be a rotating of the yarn spool 2 in the yarn spool handling container 1 to avoid spoiling of the winding due to long-term effective gravitational forces. In this way, successively the rotation of all yarn spools 2 in the yarn spool handling containers 1 is achieved. For the case that in one stocking device 64 yarn spool handling containers 1 of different types are arranged, the rotating device 67 can also be equipped with different drive spigots 68 and/or rotating device coupling elements 69 which then are used selectively.

Preferably, the employment of the yarn spool handling container 1, the yarn spooling machine assembly 21 and the method according to the invention occurs in connection with the manufacture of carbon fibers, for which viscose can also be employed. In order to achieve this, at first a fiber-shaped carbon-containing starter material is produced, which is especially polyacrylonitrile (PAN) or a so-called precursor. This fiber-shaped carbon-containing starter material is wound into a yarn spool, stocked as a yarn spool and then unwound for further processing. The further processing consists of a pyrolysis (oxidation and carbonization) during which the fiber-shaped carbon-containing starter material is converted into carbon that is arranged in a graphite-like way. Preferably, the yarn is a multifilament which can be composed of more than 12,000 single filaments (this is also referred to as 12 K). It is possible that between 12,000 and 300,000 single filaments are present in the yarn cross section. If, for example, a spool of 500 kg with a PAN sliver with 12 K single filaments is employed, a length of the yarn of 305,000 m can result, while this length for a yarn spool with a mass of 1,000 kg is 610,000 m. The weight/length resulting from this is (1,640 g)/(1,000 m) or 14,760 den [g/9,000 m]. Preferably, the yarn is flexible. The yarn spool 2 preferably is equipped with a cross-winding. The feeding speed of the yarn preferably is higher than 50 m/min. For example, the diameter of a sleeve or the outer diameter of the spindle 15 can be at least 150 mm. For the beginning of the spooling process a rotational frequency of about 106 $min^{-1}$ results from this. The maximum diameter of the winding 16 can be 1,200 mm or even more. From this, at the end of the spooling process a rotational frequency of 13.3 $min^{-1}$ results. Deviations from the aforementioned values by +/−20%, +/−10% or +/−5% are also possible.

In deviation to the embodiment shown with the realization of the yarn spooling machine 22 with the traversing unit 28 at the yarn spool handling container 1 being at rest during the winding and unwinding it is also possible that the yarn spool handling container 1 is moved while the feeding of the yarn is done in a stationary way without the use of a traversing unit 28.

For the embodiments shown, the spindle 15 in both end regions is supported in the bearings 13, 14 on the front face parts 3, 4. It is possible that the supporting is done freely protrudingly from a front face part. It is possible that in order to avoid an "overhang stress" of such a one-sided support on one front face part 3, 4, the front face part 3, 4 inflexibly supports a pin which extends into the interior of a spindle 15 realized as a hollow shaft. Between the spindle 15 and the end region of this pin at least one bearing can be effective. It is advantageous in this context if the at least one bearing is arranged in the axial region of the center of gravity of the yarn spool 2. Preferably, the mentioned pin is arranged on the front face part 3 far from the drive while the spindle 15 with the spindle coupling element 17 protrudes from the other front face part 4.

It is also possible that generally the spindle 15 or an assigned sleeve rests on a guiding outer surface with its own weight, in which way generally a rotation due to the own weight is excluded and therefore a brake device is formed. With a coupling of the yarn spool handling container 1 to the yarn spooling machine 22 then a pressurizing of air bearings in the region of the guiding outer surface can occur, in which way the rotational degree of freedom of the spindle 15 or the assigned sleeve is released.

A handling device for handling the handling containers 1 is also possibly realized in deviation to prior art: While for ordinary yarn spools 2 the handling device has to have a spindle or a fixed spigot onto which the yarn spool 2 has to be pushed from the spindle of the spooling machine, for handling of the handling container 1 according to the invention the handling device is not equipped with a spindle. Rather than that, such a handling device only comes into effective connection with the housing or frame 6 of the handling container 1, the brake device 41, possible holding portions, the supporting portion 19, protrusions 37 or apertures and/or handling portions 34, 35. It is also possible that such a handling device comprises a coupling element which can enter into effective connection with the spindle coupling element 17 of the handling container.

If a support of the spindle 15 is only done on a front face part 3, 4, the other front face part 4 can also be omitted in which way a removal of the yarn spool 2 from the handling container 1 is also possible. It is also possible that the handling container 1 itself comprises a drive for the spindle 15 or a traversing unit which then, at a coupling with the spooling machine 2, can be controlled in a suitable way 2 by the latter.

The opening 18 can also be used to guide a traversing thread guide of the traversing unit 28 as closely as possible to the yarn spool 2 so that a trailing path of the yarn from the traversing thread guide of the traversing unit 28 to the laying place on the yarn spool 2 results that is as short as possible, which has a positive effect on the spool quality. It is also possible that this realization enables the use of a removing roller on the traversing unit 28 which fixes the laid yarn on the yarn spool 2 and contributes to a compacting of the yarn spool 2. After the completion of the spooling process, the traversing unit 28 is removed again from the opening 18 in the radial direction to enable the unmounting of the handling container 1 from the yarn spooling machine 22.

The unwinding of the yarn spool 2 in an analogous way to the winding can be done on a yarn spooling machine 22 serving for unwinding, which is especially realized without a traversing unit, where it is thinkable that the yarn spool 2 is driven or braked in the unwinding. The transmission of the driving or braking torque can also be done via the spindle coupling element 17 of the yarn spool handling container 1. Preferably, the yarn spool 2 is realized without a drum, especially a drum with drum discs limiting the front faces of the winding 16.

The invention is employed with the automatic winding and/or unwinding of a technical yarn. In order to do this, especially a controlled drive is employed. Special measures can have been made on the handling container 1 and/or the yarn spooling machine 22 for catching the yarn at the beginning of the spooling process. For example, the handling container 1 can be equipped with a catching hook, a clamping device or similar by means of which a catching and fixing of the fed yarn can occur, the creation of a so-called fixing winding can occur or similar. In this context, an automatic feeding of the yarn can occur. It is also possible that the yarn is fed manually at the beginning of the spooling process.

The yarn spool handling container is formed with several construction elements 70 releaseably connected to each other. This means that by exchanging construction elements 70 there can be an adaption of the yarn spool handling container to different requirements. To mention only an example, a yarn spool handling container 1 can be formed with side parts 5 or side trusses of different lengths in order to adapt the length of the yarn spool handling container 1 and therefore the possible longitudinal extension of the yarn spool 2. Correspondingly, front face parts 3, 4 of the yarn spool handling container 1 can also be provided in different sizes to enable a modification of the yarn spool handling container 1 for yarn spool 2 of different diameters. It is also possible that in the yarn spool handling container 1 spindles 15 of different lengths and/or diameters are used depending on the yarn spool 2 to be wound. For the side parts 5 or side trusses, the front parts 3, 4 and the spindles 15 individual adaption measures can be taken depending on yarn, yarn spooling machine, spooling process, winding appearance, traversing unit used, drive of the yarn spool and similar.

In the yarn spool handling container 1 any further components not shown here can be present. To mention only an example, the yarn spool handling container 1 can be equipped with a receiving body for documentation material, for example with respect to the yarn, the processing and the manufacturing process of the yarn, a manufacturing date, the transport route, for customs-law information or usage advice for the yarn or similar. It is also possible that corresponding information is stored on a data storage medium of the yarn spool handling container, which can be written and/or read with or without a cable. It is also possible that the yarn spool handling container is equipped with an electronic control unit which works autonomously or is cross-linked with the connection of the yarn spool handling container 1 with a yarn spooling machine 22 with an electronic control unit of the yarn spooling machine 22. For example, the control of an actuator for the brake device 41 can occur via such an electronic control unit of the yarn spool handling container 1. Possibly, the yarn spool handling container 1 also has a battery or an accumulator. Any other components can also be provided in or on the yarn spool handling container 1, especially in the region of the housing or frame 6.

Many variations and modifications may be made to the preferred embodiments of the invention without departing substantially from the spirit and principles of the invention. All such modifications and variations are intended to be included herein within the scope of the present invention, as defined by the following claims.

I claim:

1. A Method of winding a technical yarn with a yarn spooling machine comprising the step of winding the technical yarn onto a yarn spool held on a spindle of a yarn spool handling container, said yarn spool handling container comprising a frame or housing to which the spindle is rotatably coupled, wherein the technical yarn is pliable, is realized as a single filament or multifilament, has a length wound onto the yarn spool of more than 100 kilometers (km), has a weight/length ratio in a range of 10,000 to 20,000 denier and is wound on the yarn spool as a cross winding.

2. The method according to claim 1, wherein the spindle comprises a spindle coupling element by which the spindle is connectable to a yarn spooling machine coupling element of a rotary drive of the yarn spooling machine.

3. The method according to claim 2, wherein the frame or the housing comprises at least one of:

- a supporting portion or holding portion for supporting or holding the yarn spool handling container on the yarn spooling machine;
- a handling portion for handling the yarn spool handling container;
- a coupling portion for coupling to another yarn spool handling container; and
- a guiding unit.

4. The method according to claim 1, wherein the yarn spool handling container comprises multiple construction elements releasably connected to each other, where by exchanging construction elements the yarn spool handling container is adapted to different requirements.

5. The method according to claim 1, wherein the housing or the frame has an opening therein through which during the winding the technical yarn is passed and in the region of which during a use of the yarn spool handling container with the yarn spooling machine a traversing unit extends.

6. The method according to claim 1, wherein a brake device is provided which is effective between the frame or housing and the spindle or a sleeve arranged on the spindle.

7. The method according to claim 6, wherein the brake device is actuated in a motion-controlled way.

8. The method according to claim 1, wherein the spindle is supported on the frame or housing on both sides of an axial segment of the spindle on which the yarn spool is arranged.

9. The method according to claim 1, wherein the technical yarn wound onto the yarn spool has a mass of more than 300 kilograms (kg).

10. A method for handling a yarn spool with a technical yarn spooling machine and a yarn spool handling container, the yarn spool handling container comprising a frame or housing, the technical yarn spooling machine comprising a rotary drive, the rotary drive comprising a yarn spooling machine coupling element adapted to couple the rotary drive to a spindle coupling element of a spindle that is external to the technical yarn spooling machine and that holds the yarn spool, the spindle being rotatably supported by the frame or housing, the method comprising:

a) providing the yarn spool handling container in the region of the technical yarn spooling machine;

b) coupling the spindle coupling element to the yarn spooling machine coupling element, wherein the rotary drive of the technical yarn spooling machine transmits a driving torque to the spindle via the coupling of the yarn spooling machine coupling element to the spindle coupling element of the spindle;

c) via the driving torque transmitted to the spindle via the coupling of the yarn spooling machine coupling element to the spindle coupling element of the spindle, winding the technical yarn onto the yarn spool that is held on the spindle wherein the technical yarn is pliable, is realized as a single filament or multifilament, has a length wound onto the yarn spool of more than 100 kilometers (km), has a weight/length ratio in a range of 10,000 to 20,000 denier and is wound on the yarn spool as a cross winding;

d) releasing the coupling of the spindle coupling element of the yarn spool handling container to the yarn spooling machine coupling element; and e) transporting the yarn spool handling container along with the yarn spool having the technical yarn wound thereon away from the yarn spooling machine.

11. The method according to claim 10, wherein at least one of the coupling of the spindle coupling element to the yarn spooling machine coupling element and the releasing of the coupling of the spindle coupling element to the yarn spooling machine coupling element is induced in a motion-controlled way with the approach of the yarn spool handling container to the technical yarn spooling machine or removal of the yarn spool handling container from the technical yarn spooling machine.

12. The method according to claim 10, wherein a brake device of the yarn spool handling container is actuated in a motion-controlled way with the approach of the yarn spool handling container to the yarn spooling machine or removal of the yarn spool handling container from the yarn spooling machine.

13. The method according to claim 10, wherein a) through e) are performed a plurality of times for a plurality of respective yarn spool handling containers to wind technical yarn onto respective yarn spools held on respective spindles of respective yarn spool handling containers, the method further comprising:

f) storing the yarn spool handling containers along with the respective yarn spools having the technical yarn wound thereon in a stocking device.

14. The method according to claim 13, wherein in the stocking device the yarn spools are rotated in the yarn spool handling containers.

15. The method according to claim 10, further comprising:

f) while the yarn spool is held on the spindle in the yarn spool handling container, unwinding the technical yarn from the yarn spool for further use.

16. The method according to claim 10, wherein the yarn spool is transported in the yarn spool handling container.

* * * * *